US010147576B2

(12) United States Patent
Morimoto

(10) Patent No.: US 10,147,576 B2
(45) Date of Patent: Dec. 4, 2018

(54) ELECTROMAGNETIC SWITCH DEVICE FOR STARTER

(71) Applicant: Mitsubishi Electric Corporation, Tokyo (JP)

(72) Inventor: Yoshihiro Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/540,797

(22) PCT Filed: Apr. 7, 2015

(86) PCT No.: PCT/JP2015/060846
§ 371 (c)(1),
(2) Date: Jun. 29, 2017

(87) PCT Pub. No.: WO2016/162948
PCT Pub. Date: Oct. 13, 2016

(65) Prior Publication Data
US 2018/0005790 A1 Jan. 4, 2018

(51) Int. Cl.
*H01H 51/06* (2006.01)
*H01H 50/14* (2006.01)
(Continued)

(52) U.S. Cl.
CPC ..... *H01H 51/065* (2013.01); *F02N 11/087* (2013.01); *F02N 15/006* (2013.01);
(Continued)

(58) Field of Classification Search
CPC ..... H01H 50/14; H01H 50/42; H01H 51/065; H01R 9/24; H01R 43/16; H01R 43/24;
(Continued)

(56) References Cited

U.S. PATENT DOCUMENTS 5,677,656 A 10/1997 Mauch et al.
6,380,831 B1 4/2002 Kajino
2009/0002105 A1 1/2009 Bradfield et al.

FOREIGN PATENT DOCUMENTS

JP 8-504913 A 5/1996
JP 2002-138931 A 5/2002

OTHER PUBLICATIONS

International Search Report for PCT/JP2015/060846, dated May 19, 2015 (PCT/ISA/210).

*Primary Examiner* — Ramon M Barrera
(74) *Attorney, Agent, or Firm* — Sughrue Mion, PLLC; Richard C. Turner

(57) ABSTRACT

An electromagnetic switch device for starter includes a connector assembly which has a plurality of connectors formed by stamping a conductive material and which forms a motor electric circuit and an electric circuit for supplying power to an attraction coil and a holding coil, wherein the connector assembly includes: a connector (A) connecting one of a pair of sub fixed contacts and a battery terminal; a connector (B) connecting the other one of the pair of sub fixed contacts, and one end of the attraction coil and one end of the holding coil; a connector (C) connecting the other end of the attraction coil and a motor terminal; a connector (D) connecting one end of a sub coil and an S terminal; and a resin member integrally fixing at least one pair of the connector (A), the connector (B), the connector (C), and the connector (D).

19 Claims, 16 Drawing Sheets

(51) Int. Cl.

| | |
|---|---|
| ***F02N 11/08*** | (2006.01) |
| ***H01H 50/02*** | (2006.01) |
| ***H01H 50/42*** | (2006.01) |
| ***H01H 50/54*** | (2006.01) |
| ***H01R 4/30*** | (2006.01) |
| ***H01R 9/24*** | (2006.01) |
| ***H01R 39/02*** | (2006.01) |
| ***F02N 15/00*** | (2006.01) |
| ***F02N 15/06*** | (2006.01) |
| ***H01R 43/16*** | (2006.01) |
| *F02N 15/02* | (2006.01) |
| *H01R 43/24* | (2006.01) |

(52) U.S. Cl.

CPC ..... *F02N 15/067* (2013.01); *H01H 50/023* (2013.01); *H01H 50/14* (2013.01); *H01H 50/42* (2013.01); *H01H 50/541* (2013.01); *H01R 4/30* (2013.01); *H01R 9/24* (2013.01); *H01R 39/02* (2013.01); *H01R 43/16* (2013.01); *F02N 11/0851* (2013.01); *F02N 15/022* (2013.01); *F02N 2011/0874* (2013.01); *H01H 2231/026* (2013.01); *H01R 43/24* (2013.01); *H01R 2201/10* (2013.01)

(58) Field of Classification Search

CPC ..... F02N 11/087; F02N 2011/0874; F02N 15/067

See application file for complete search history.

ELECTROMAGNETIC SWITCH DEVICE FOR STARTER

CROSS REFERENCE TO RELATED APPLICATIONS

This application is a National Stage of International Application No. PCT/JP2015/060846 filed Apr. 7, 2015, the contents of all of which are incorporated herein by reference in their entirety.

TECHNICAL FIELD

The present invention relates to an electromagnetic switch device for starter, used for a starter for starting an engine provided to an automobile, for example.

BACKGROUND ART

Conventionally, an electromagnetic switch device for starter, used for a starter for starting a large-displacement engine of, in particular, a bus, a truck, or the like, needs to be supplied with large current for causing the electromagnetic switch device to operate, and a relay called an auxiliary relay, which has a smaller size than the electromagnetic switch device for starter, is used as current supplying means therefor.

The auxiliary relay is provided near the electromagnetic switch device for starter and is connected via wirings to form an electric circuit. However, it is often difficult to ensure a space for providing the auxiliary relay in an engine chamber, and also it is often difficult to arrange the wirings. Therefore, there is known an electromagnetic switch device for starter that includes such an auxiliary relay for which the providing space and the wirings are not needed (for example, Patent Documents 1 to 3).

An embodiment in FIG. 1 in Patent Document 1 and embodiments in Patent Documents 2, 3 each disclose an electromagnetic switch device for starter in which an auxiliary relay is provided between a solenoid coil and a movable contact.

An embodiment in FIG. 5 in Patent Document 1 discloses an electromagnetic switch device for starter in which an auxiliary relay is provided with a part thereof protruding outward in the axial direction from a terminal block.

CITATION LIST

Patent Document

Patent Document 1: US2009/0002105 A1

Patent Document 2: Japanese Laid-Open Patent Publication No. 2002-138931

Patent Document 3: Japanese Translation of PCT International Application Publication No. 8-504913

SUMMARY OF THE INVENTION

Problems to be Solved by the Invention

However, in the embodiment in FIG. 1 in Patent Document 1 and the embodiments in Patent Documents 2, 3, the solenoid coil of the auxiliary relay is wound around the outer circumference of the movable contact of the electromagnetic switch device for starter, and therefore the development length of the coil is increased.

When the development length of the coil is increased, the coil resistance is increased, resulting in a problem that it is impossible to supply current needed for the auxiliary relay to operate.

In order to solve this problem, it is necessary to increase the sectional area of the coil element wire of the solenoid coil of the auxiliary relay, resulting in a problem that the size of the solenoid coil of the auxiliary relay is enlarged and the manufacturing cost is increased.

In the embodiment in FIG. 5 in Patent Document 1, the auxiliary relay is provided so as to protrude in the axial direction, thereby solving the problem that the size of the solenoid coil of the auxiliary relay is enlarged and the manufacturing cost is increased. However, when the auxiliary relay protrudes in the axial direction, vehicle mountability is deteriorated.

Further, since the auxiliary relay is located at a position away from the engine attachment surface of the starter, vibration response is increased, to cause a problem that vibration resistance is deteriorated.

The present invention has been made to solve the above problems, and an object of the present invention is to provide an electromagnetic switch device for starter in which an auxiliary relay is provided and which has excellent vehicle mountability and is low in cost.

Solution to the Problems

An electromagnetic switch device for starter according to the present invention includes:

an electromagnetic switch which includes a pair of main fixed contacts, a main movable contact, an attraction coil, and a holding coil and which opens and closes an electric circuit for a motor via the pair of main fixed contacts, and when the attraction coil and the holding coil are energized, moves an overrunning clutch via a shift lever;

an auxiliary relay which includes a pair of sub fixed contacts, a sub movable contact, and a sub coil, the pair of sub fixed contacts being connected to the attraction coil and the holding coil of the electromagnetic switch, the auxiliary relay energizing the attraction coil and the holding coil of the electromagnetic switch via the pair of sub fixed contacts in response to a starting signal; and a connector assembly which includes a plurality of connectors formed by stamping a conductive material, and which forms the motor electric circuit and an electric circuit for supplying power to the attraction coil and the holding coil, wherein the connector assembly includes

- a connector (A) connecting one of the pair of sub fixed contacts, and the battery terminal,
- a connector (B) connecting the other one of the pair of sub fixed contacts, and one end of the attraction coil and one end of the holding coil,
- a connector (C) connecting the other end of the attraction coil and the motor terminal,
- a connector (D) connecting one end of the sub coil and an S terminal, and
- a resin member integrally fixing at least one pair of the connector (A), the connector (B), the connector (C), and the connector (D).

Effect of the Invention

In the electromagnetic switch device for starter according to the present invention, the connector assembly having a plurality of connectors formed by stamping a conductive material forms the motor electric circuit and the electric circuit for supplying power to the attraction coil and the holding coil, thus providing effects of facilitating assembly work and connection work, downsizing the entire device, and improving vehicle mountability and vibration resistance.

DESCRIPTION OF EMBODIMENTS

Embodiment 1

Figure 1:
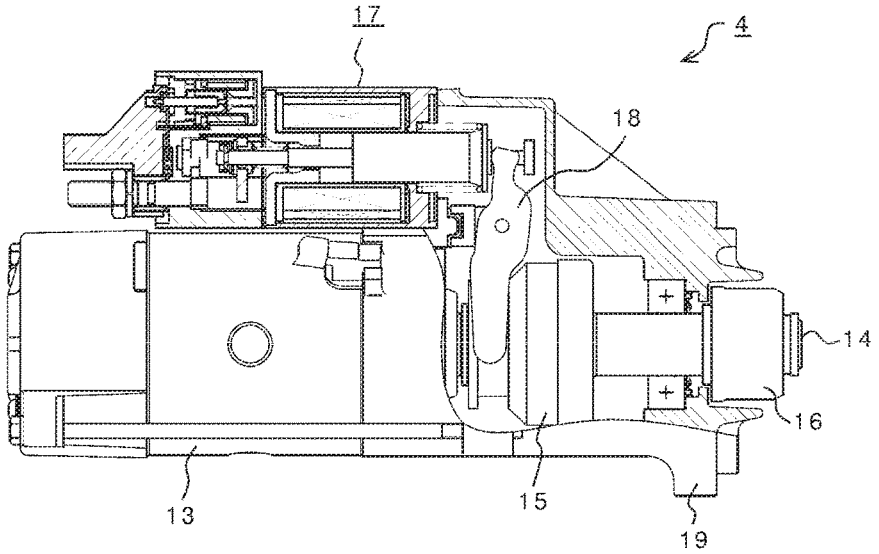
FIG. 1 is a partial sectional view of a starter provided with an electromagnetic switch device for starter according to embodiment 1 of the present invention.
Figure 2:
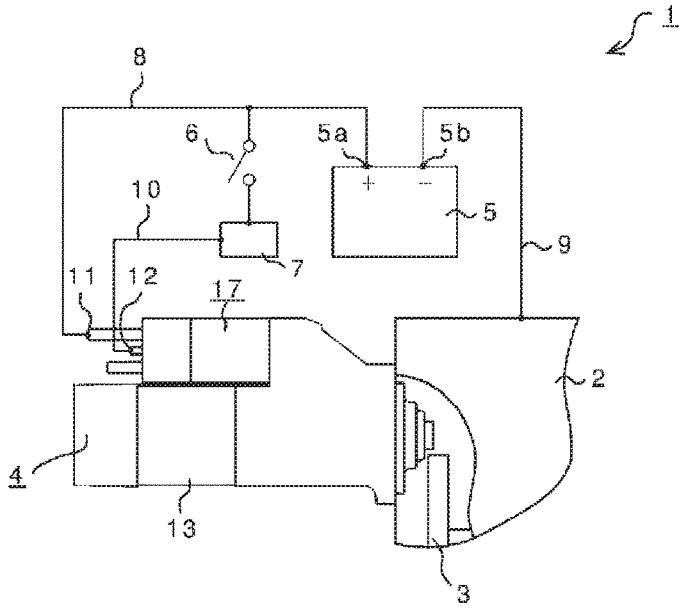
FIG. 2 is a schematic diagram of an internal combustion engine device according to embodiment 1 of the present invention.
Figure 3:
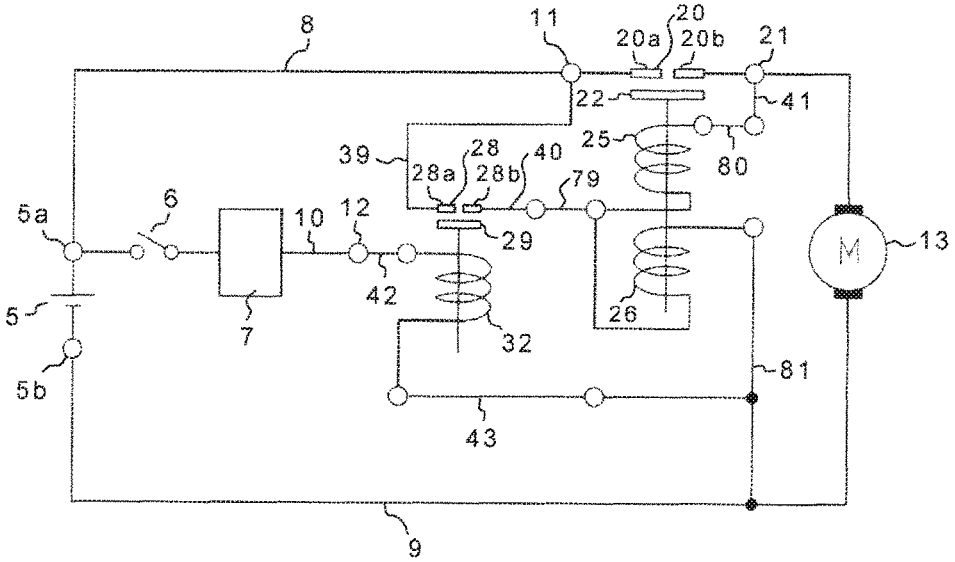
FIG. 3 is an electric circuit diagram of the starter provided with the electromagnetic switch device for starter according to embodiment 1 of the present invention.
Figure 4:
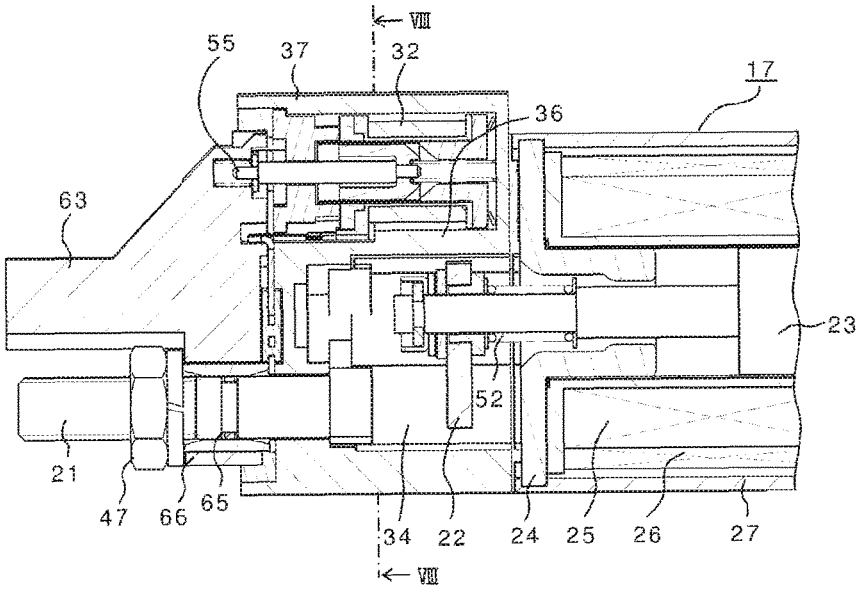
FIG. 4 is an enlarged sectional view of the electromagnetic switch device for starter in FIG. 1.

In FIGS. 1 to 16, an internal combustion engine device 1 includes an engine 2, a ring gear 3, a starter 4, a battery 5, a key switch 6, a control device 7, a battery plus wire 8, a battery minus wire 9, and an S circuit (+) wire 10.

The engine 2 is an internal combustion engine, and since the engine 2 cannot be started by itself, the engine 2 starts self-rotation by receiving a rotational force from the starter 4 via the ring gear 3.

The ring gear 3 transmits the rotational force from the starter 4 to the engine 2, and is directly connected to the engine 2.

The starter 4 generates a rotational force by power from the battery 5, and transmits the rotational force to the engine 2 via the ring gear 3.

The battery 5 is a secondary battery storing power for rotating the starter 4, and is electrically connected to the starter 4 via the battery plus wire 8 and the battery minus wire 9.

The key switch 6 causes the starter 4 to rotate when turned on, and causes the starter 4 to stop when turned off.

The control device 7 performs overall determination as to the ON/OFF state of the key switch 6 and other starting conditions, and transmits a starting signal to the starter 4.

The battery plus wire 8 connects a battery plus terminal 5*a* of the battery 5 and a battery terminal 11 of the starter 4. The battery minus wire 9 is connected to the battery minus terminal 5*b* and the engine 2, whereby the battery 5 and the starter 4 are electrically connected.

The S circuit wire (+) 10 is a wire electrically connecting the control device 7 and an S terminal (starting terminal) 12 of the starter 4.

Next, the configuration of the starter 4 will be described.

The starter 4 includes a motor 13, an output shaft 14, an overrunning clutch 15, a pinion 16, an electromagnetic switch device 17 for starter, a shift lever 18, and a front bracket 19.

The motor 13 generates a rotational force by power from the battery 5. The output shaft 14 transmits the rotational force of the motor 13 to the overrunning clutch 15.

The overrunning clutch 15 is provided on the output shaft 14 so as to be movable in the axial direction, and transmits, to the pinion 16, the rotational force of the motor 13 transmitted from the output shaft 14.

The pinion 16 transmits, to the ring gear 3 of the engine 2, the rotational force of the motor 13 transmitted from the overrunning clutch 15.

The electromagnetic switch device 17 for starter moves the overrunning clutch 15 in the axial direction on the output shaft 14 via the shift lever 18, and opens or closes an electric circuit between the battery 5 and the motor 13 in response to the starting signal from the control device 7.

The shift lever 18 transmits a thrust of the electromagnetic switch device 17 for starter to the overrunning clutch 15, to move the overrunning clutch 15 on the output shaft 14.

The front bracket 19 fixes the starter 4 to the engine 2, and forms an electric circuit of the motor 13 and the electromagnetic switch device 17 for starter.

Next, the configuration of the electromagnetic switch device 17 for starter will be described.

The electromagnetic switch device 17 for starter in embodiment 1 includes: a pair of main fixed contacts 20 which form a motor electric circuit for supplying power to the motor 13 and are located at positions electrically and mechanically away from each other; the battery terminal 11 having an end at which one main fixed contact 20*a* of the pair of main fixed contacts 20 is formed, and having another end to which a wire electrically connected to the battery plus terminal 5*a* of the battery 5 is fixed; a motor terminal 21 having an end at which the other main fixed contact 20*b* of the pair of main fixed contacts 20 is formed, and having another end to which a wire connected to the motor 13 is fixed; a main movable contact 22 which electrically connects the pair of main fixed contacts 20 to form the motor electric circuit; a main movable core 23 which is made of a magnetic material and moves the main movable contact 22 toward the pair of main fixed contacts 20; a main fixed core 24 which is made of a magnetic material and generates an attraction force between the main movable core 23 and the main fixed core 24; an attraction coil 25 which generates a magnetic field for attracting the main movable core 23 to the main fixed core 24; a holding coil 26 which generates a magnetic field for holding the main movable core 23 at the movement end after the attraction; and a main yoke 27 which is made of a magnetic material and serves as a magnetic circuit for the magnetic field generated by the attraction coil 25 and the holding coil 26.

In addition, the electromagnetic switch device 17 for starter includes: a pair of sub fixed contacts 28 which form an electric circuit for supplying power to the attraction coil 25 and the holding coil 26 and are located at positions electrically and mechanically away from each other; a sub movable contact 29 which forms the electric circuit for supplying power to the attraction coil 25 and the holding coil 26 by electrically connecting the pair of sub fixed contacts 28; a sub movable core 31 which is made of magnetic material and generates a propulsive force for moving the sub movable contact 29 toward the pair of sub fixed contacts 28; a sub coil 32 which generates a magnetic field as a base for the propulsive force of the sub movable core 31; a sub yoke 30 which serves as a magnetic circuit for the magnetic field of the sub coil 32; a pair of sub fixed cores (A) 60, (B) 61 which are located at both ends of the sub yoke 30 and serve as a magnetic circuit; a main contact chamber 34 forming a space in which the pair of main fixed contacts 20 are located and the main movable contact 22 can move; and a sub contact chamber 35 forming a space in which the pair of sub fixed cores (A) 60, (B) 61 are located and the sub movable contact 29 can move.

Further, the electromagnetic switch device 17 for starter includes a terminal block 37 in which the main contact chamber 34 and the sub coil 32 are located adjacent to each other in the radial direction with a partition wall 36 provided therebetween and separating the sub coil 32 and the main contact chamber 34 from each other.

Figure 9:
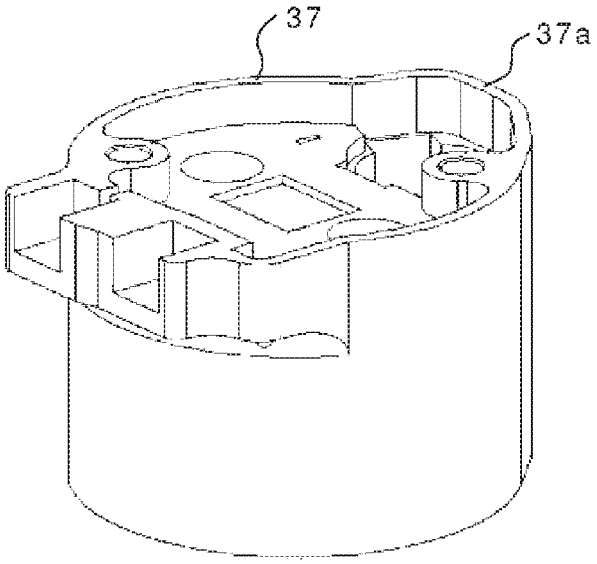
FIG. 9 is a perspective view showing the terminal block of the electromagnetic switch device for starter according to embodiment 1 of the present invention.
Figure 10:
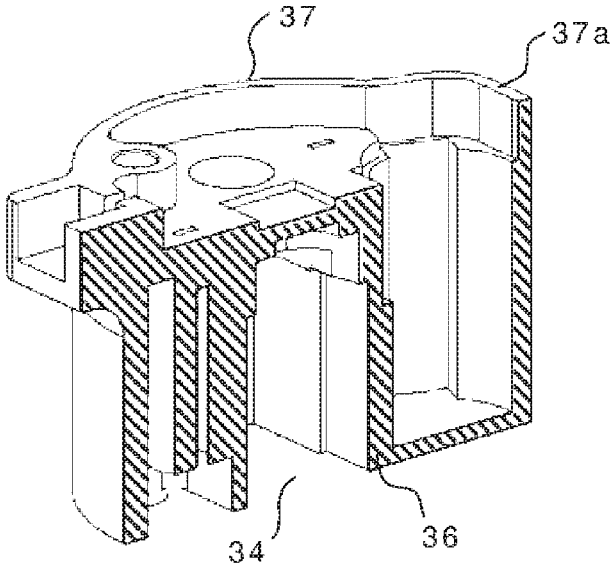
FIG. 10 is a perspective sectional view of the terminal block shown in FIG. 9.

As shown in FIG. 9 and FIG. 10, the terminal block 37 basically has a cylindrical shape and has the main contact chamber 34 and a protruding portion 37*a* which are formed in the radial direction, and in the terminal block 37, the sub coil 32 and the main contact chamber 34 are located adjacent to each other in the radial direction with the partition wall 36 provided therebetween.

Further, the electromagnetic switch device 17 for starter includes a plurality of connectors formed by stamping a conductive material, and thus includes a connector assembly 45 forming the motor electric circuit and an electric circuit for supplying power to the attraction coil 25 and the holding coil 26.

In the above configuration, the pair of main fixed contacts 20 is composed of the main fixed contact 20*a* provided at one end of the battery terminal 11, and the main fixed contact 20*b* provided at one end of the motor terminal 21, and has a contact surface to be in contact with the main movable contact 22. The pair of main fixed contacts 20 form the electric circuit for the motor 13 when the main movable contact 22 is in contact therewith.

The battery terminal 11 is a conductor, and has a screw portion at one end (left side in FIG. 6) thereof and a head portion at another end thereof.

A nut 46 for fixing the terminal block 37 and a nut (not shown) for fixing the battery plus wire 8 are screwed to the screw portion of the battery terminal 11.

The end surface of the head portion at the other end forms one main fixed contact 20*a* of the pair of main fixed contacts 20, and is a surface to be in contact with the main movable contact 22.

A side surface 11*a* of the head portion is a surface fitted to the terminal block 37, and restricts rotation of the battery terminal 11 relative to the terminal block 37.

The motor terminal 21 is a conductor, and has a screw portion at one end (left side in FIG. 6) thereof and a head portion at another end thereof, as in the battery terminal 11.

A nut 47 for fixing the terminal block 37 and a nut 48 for fixing a motor wire 49 are screwed to the screw portion of the motor terminal 21.

The end surface of the head portion at the other end forms the other main fixed contact 20*b* of the pair of main fixed contacts 20, and is a surface to be in contact with the main movable contact 22. As in the battery terminal 11, the head portion has a surface to be fitted to the terminal block 37, thereby restricting rotation of the motor terminal 21 relative to the terminal block 37.

The main movable contact 22 is a plate-shaped conductive material having, at the center thereof, a through hole through which the main movable core 23 penetrates. One end surface (left side in FIG. 6) in the plate-thickness direction of the main movable contact 22 forms a surface to be in contact with the pair of main fixed contacts 20 and a surface to be in contact with an insulating plate 50, the other end surface thereof forms a surface to be in contact with an insulating member 51, and the inner circumferential surface of the through hole forms a surface to be in contact with the insulating member 51.

The main movable contact 22 is held in an insulated manner by the insulating member 51 and the insulating plate 50 with respect to the main movable core 23.

The main movable core 23 is a solid round stepped rod made of a magnetic material, and forms a magnetic circuit.

The insulating plate 50, the insulating member 51, the main movable contact 22, and a main contact spring 52 are fixed to a small-diameter portion 23*a* of the main movable core 23, by a fastening ring 53.

A surface, of the main movable core 23, opposed to the main fixed core 24 forms a surface to be in contact with the main fixed core 24.

The shift lever 18 is engaged with a hook-shaped portion 23*b* provided on the side opposite to the small-diameter portion 23*a*.

In the present embodiment, the main movable core 23 is a solid round stepped rod. However, the main movable core 23 may be formed in a hollow shape as long as a sectional area for the magnetic circuit is ensured, or may be formed in a hollow shape so that an engagement spring is provided therein, thereby to be applied to an electromagnetic push type starter.

The main fixed core 24 is a cylinder made of a magnetic material. The main fixed core 24 has a flange portion 24*a* at one end thereof and a stepped through hole at the center thereof, and forms a magnetic circuit.

The outer circumference of the flange portion 24*a* is fitted to the main yoke 27, and one end surface of the flange portion 24*a* is a surface to be swaged and fixed circumferentially after the fitting to the main yoke 27.

The other end surface of the flange portion 24*a* is in contact with the main yoke 27 and a bobbin 54 wound with the attraction coil 25 and the holding coil 26.

A lead-out portion 54*a* of the attraction coil 25 and the holding coil 26 of the bobbin 54, a lead-out portion 54*b* of the attraction coil 25, and a lead-out portion 54*c* of the holding coil are respectively fitted to through holes 24*b*, 24*c*, 24*d* formed in the flange portion 24*a*. The small-diameter portion 23*a* of the main movable core 23 penetrates through the through hole at the center (see FIG. 16).

The attraction coil 25 is an enamel-coated conductor wound around the bobbin 54, and generates a magnetic field for attracting the main movable core 23 toward the main fixed core 24.

One end of the attraction coil 25 is connected to a terminal (A) 79, and the other end thereof is connected to a terminal (B) 80.

The holding coil 26 is an enamel-coated conductor wound around the outer circumference of the attraction coil 25, and generates a magnetic field for attracting and holding the main movable core 23 toward the main fixed core 24. One end of the holding coil 26 is connected to the terminal (A) 79 together with the attraction coil 25, and the other end thereof is fixed to a terminal (C) 81 to be electrically connected to the battery minus wire 9.

The main yoke 27 is made of a magnetic material and serves as a magnetic circuit for the magnetic field generated by the attraction coil 25 and the holding coil 26.

The main yoke 27 has a bottomed cylindrical shape, and has, at the bottom thereof, a through hole through which the main movable core 23 penetrates, and a screw hole (not shown) for fixation to the front bracket 19. The attraction coil 25 and the holding coil 26 are stored inside the cylindrical body of the main yoke 27.

A thin portion 27*a* which is thinner than a cylinder part is formed at an end surface side opposite to the bottom side of the cylinder body. After the main fixed core 24 is fitted to the thin portion 27*a*, the entire circumference at the end of the thin portion 27*a* is swaged so as to be folded radially inward, whereby the main fixed core 24 is fixed.

One sub fixed contact 28*a* of the pair of sub fixed contacts 28 is formed by a plate material made from the same conductor as a connector (A) 39, and the other sub fixed contact 28*b* is formed by a plate material made from the same conductor as a connector (B) 40, to form an electric circuit for the attraction coil 25 and the holding coil 26.

A surface, of the pair of sub fixed contacts 28, that is one end surface in the plate-thickness direction and is opposed to the sub movable contact 29 is a surface to be in contact with the sub movable contact 29.

The sub movable contact 29 is a plate material made from a conductor. The sub movable contact 29 has, at the center thereof, a through hole through which a rod 55 penetrates, and forms an electric circuit for the attraction coil 25 and the holding coil 26.

One end surface in the plate-thickness direction of the sub movable contact 29 is a surface to be in contact with the pair of sub fixed contacts 28.

The sub fixed core (A) 60 is a magnetic circuit formed by the same member as the sub yoke 30, and is made of a magnetic material.

The sub fixed core (A) 60 has a brim portion and a through hole through which the sub movable core 31 penetrates, at the center thereof. One end surface of the sub fixed core (A) 60 is a surface to be in contact with a spacer 56, and the other end surface thereof is a surface to be in contact with a bobbin 57.

The sub fixed core (B) 61 is a magnetic circuit and is made of a magnetic material, as in the sub fixed core (A) 60. The sub fixed core (B) 61 has a through hole through which a sub return spring 58 penetrates, at the center thereof, and has a flange at one end thereof. One end surface of the flange forms a surface to be in contact with a gap adjustment spring 59, and the other end surface thereof forms a surface to be in contact with the bobbin 57.

The sub yoke 30 is a magnetic circuit formed by the same member as the sub fixed core (A) 60, and is made of a magnetic material.

Figure 11:
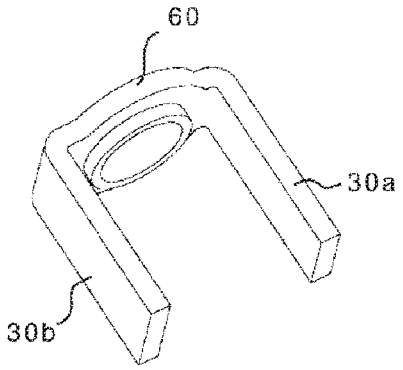
FIG. 11 is a perspective view of a sub fixed core of the electromagnetic switch device for starter according to embodiment 1 of the present invention.

The sub yoke 30 includes: a sub yoke 30*a* formed by bending, at a right angle toward the sub fixed core (B) 61, a flat plate portion extending from the center of the sub fixed core (A) 60 toward the battery terminal 11; and a sub yoke 30*b* formed by bending, at a right angle toward the sub fixed core (B) 61, a flat plate portion extending from the center of the sub fixed core (A) 60 toward the motor terminal 21 (see FIG. 11).

Figure 8:
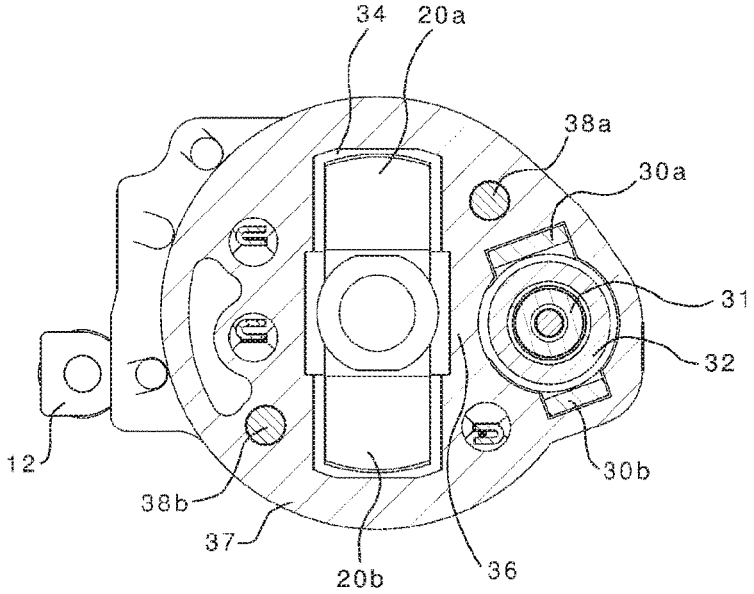
FIG. 8 is a sectional view of the electromagnetic switch device for starter according to embodiment 1 of the present invention, along VIII-VIII line in FIG. 4.

Since the sub yoke 30*a* is arranged in the direction of the battery terminal 11 and the sub yoke 30*b* is arranged in the direction of the motor terminal 21, the sub yokes 30*a*, 30*b* are arranged so as to avoid the partition wall 36 direction and the outermost circumferential direction of the terminal block 37 (see FIG. 8).

The sub coil 32 is provided at an inner surface in the axial direction, of the sub yoke 30*a*, and a surface opposed to the sub fixed core (B) 61 is formed at one end (right side in FIG. 7) on the inner surface.

In embodiment 1, the surface, of the sub yoke 30, opposed to the sub fixed core (B) 61 is the inner surface of the sub yoke 30, but may be an axial end surface of the sub yoke, or both of the inner surface and the axial end surface may form the opposed surface so that the respective opposed surfaces are fitted to each other via protrusion and recess.

The sub movable core 31 serves as a magnetic circuit for the magnetic field generated by the sub coil 32, and has a cylindrical body made of a magnetic material and having a taper surface 31*a* at one end thereof and a stepped hole at the center thereof.

The sub coil 32 wound around the bobbin 57 and the sub fixed core (A) 60 are arranged around the outer circumference of the cylinder part of the sub movable core 31, the taper surface 31*a* is a surface to be in contact with the sub fixed core (B) 61, and the other end of the sub movable core 31 is opposed to the spacer 56.

One end of the sub return spring 58 is stored in a hole formed at the center on the taper surface 31*a* side, and the rod 55 is stored in a hole formed at the center on the other end side.

The sub coil 32 is an enamel-coated conductor wound around the bobbin 57, and generates a magnetic field for moving and holding the sub movable core 31 toward the sub fixed core (B) 61.

One end of the sub coil 32 is connected to a connector (D) 42 to be electrically connected to the S terminal 12. The other end thereof is connected to a connector (E) 43 to be electrically connected to the battery minus terminal 5*b* of the battery 5.

The main contact chamber 34 is a space in which the pair of main fixed contacts 20 provided to the terminal block 37 are located and the main movable contact 22 can move.

The sub contact chamber 35 is a space in which the pair of sub fixed contacts 28 and the sub movable contact 29 provided in a cover 63 are located, in a space in which the sub coil 32 and the spacer 56 provided in the terminal block 37 are located.

The terminal block 37 is made of an insulating material and has a cylindrical shape a part of which protrudes in the radial direction. At one end side (left side in FIGS. 6, 7), the terminal block 37 is provided with the connector (A) 39, the connector (B) 40, a connector (C) 41, the connector (D) 42, the connector (E) 43, and the S terminal 12, and has an opening of the space in which the sub coil 32 is located. At the other end (right side in FIGS. 6, 7), the terminal block 37 has a surface to be in contact with the main fixed core 24 and also has an opening of the main contact chamber 34. The terminal block 37 has, in the main contact chamber 34, a surface to be fitted to the battery terminal 11 and a surface to be fitted to the motor terminal 21.

The space in which the sub coil 32 is located and the main contact chamber 34 are arranged adjacent to each other in the radial direction, and the sub coil 32 and the main contact chamber 34 are separated from each other via the partition wall 36.

A bolt 38*a* located on the sub coil 32 side and a bolt 38*b* located on the S terminal 12 side are used for fixing the terminal block 37 to the main fixed core 24. The head portions of these bolts are in contact with the end surface of the terminal block 37, and the screw portions thereof are screwed into screw holes 24*e* provided in the main fixed core 24.

The bolts 38*a*, 38*b* are made of a magnetic material, and the bolt 38*a* located on the sub coil 32 side forms a magnetic circuit between the sub fixed core (A) 60 and the sub fixed core (B) 61, as in the sub yoke 30.

The connector (A) 39 is made of a conductive material and forms an electric circuit for the attraction coil 25 and the holding coil 26.

The connector (A) 39 has an end provided with one sub fixed contact 28*a* of the pair of sub fixed contacts 28, and another end in contact with a metal bush (A) 64 which is formed integrally with the resin cover 63 around the outer circumference of the battery terminal 11.

A side, of the metal bush (A) 64, opposite to its surface in contact with the connector (A) 39 is in contact with a washer 74*a*, which is fixed by the nut 46 screwed to the battery terminal 11.

The connector (B) 40 is made of a conductive material and forms an electric circuit for the attraction coil 25 and the holding coil 26. The connector (B) 40 has an end provided with one sub fixed contact 28*b* of the pair of sub fixed contacts 28, and another end connected to the terminal (A) 79 to be electrically connected to one end of the attraction coil 25 and one end of the holding coil 26.

The connector (C) 41 is made of a conductive material and forms an electric circuit for the attraction coil 25. One end of the connector (C) 41 is connected to the terminal (B) 80 to be electrically connected to the attraction coil 25.

The other end of the connector (C) 41 is in contact with a metal bush (B) 65 which is formed integrally with the resin cover 63 around the outer circumference of the motor terminal 21.

A side, of the metal bush (B) 65, opposite to its surface in contact with the connector (C) 41 is in contact with a washer 74*b*, which is fixed by the nut 47 screwed to the motor terminal 21.

The connector (D) 42 is made of a conductive material and forms an electric circuit for the sub coil 32. One end of the connector (D) 42 is connected to the S terminal 12, and the other end thereof is connected to one end of the sub coil 32.

The connector (E) 43 is made of a conductive material and forms an electric circuit for the sub coil 32. One end of the connector (E) 43 is connected to one end of the sub coil 32, and the other end of the connector (E) 43 is connected to the terminal (C) 81 to be electrically connected to the holding coil 26.

The connector assembly 45 is obtained by stamping a conductive sheet material including the connector (A) 39, the connector (B) 40, the connector (C) 41, the connector (D) 42, the connector (E) 43, a connector (F) 44, tie bars 45*a*, and a support frame 45*b*, integrally molding the stamped material as an insert material with a resin member 67, and then stamping the tie bars 45*a* so that the connector (A) 39, the connector (B) 40, the connector (C) 41, the connector (D) 42, the connector (E) 43, and the connector (F) 44 are electrically separated from each other.

The connector assembly 45 is electrically separated after the tie bars 45*a* are stamped, but owing to the resin member 67, the connector assembly 45 is not mechanically separated.

Figure 12:
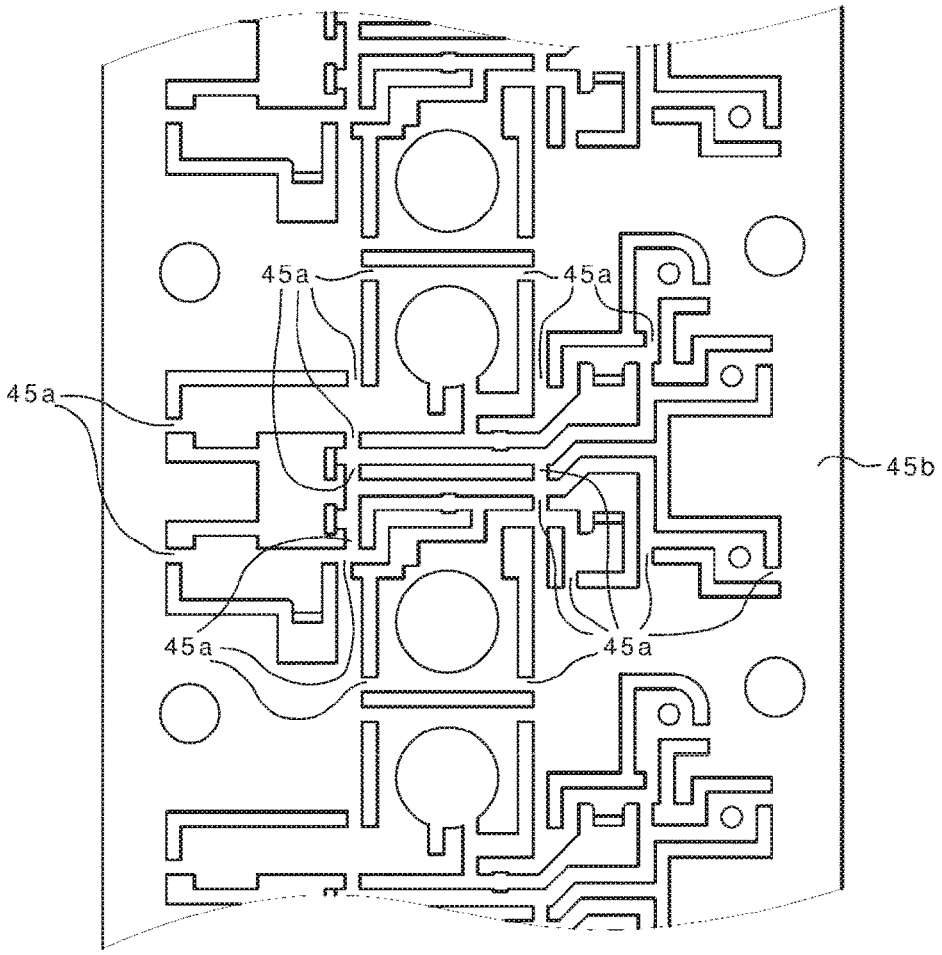
FIG. 12 is a plan view showing a part of a hoop material of a connector assembly after sheet metal stamping and before resin molding, in the electromagnetic switch device for starter according to embodiment 1 of the present invention.
Figure 13:
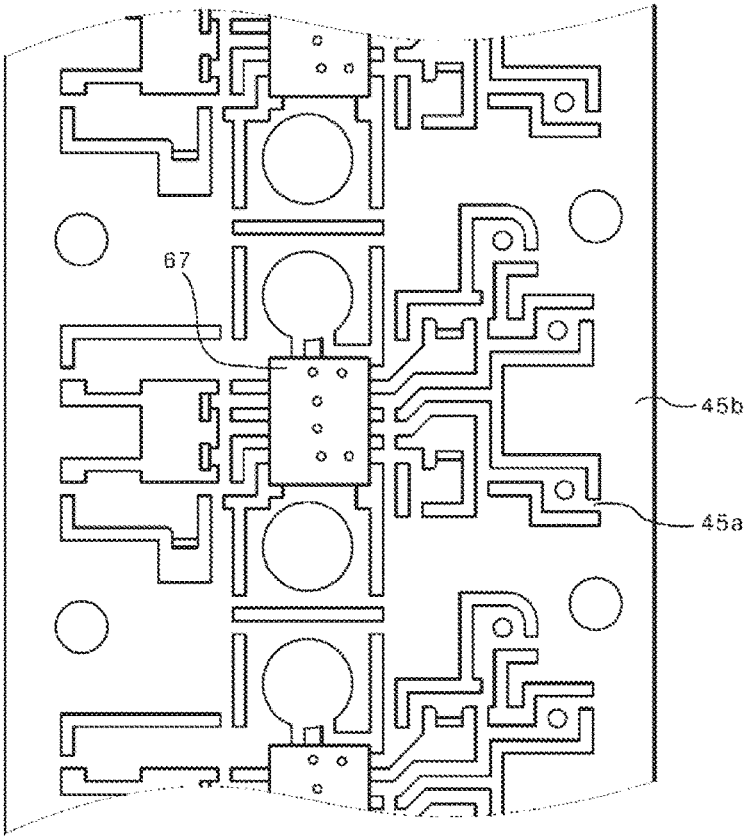
FIG. 13 is a plan view of the connector assembly after resin molding, in the electromagnetic switch device for starter according to embodiment 1 of the present invention.
Figure 14:
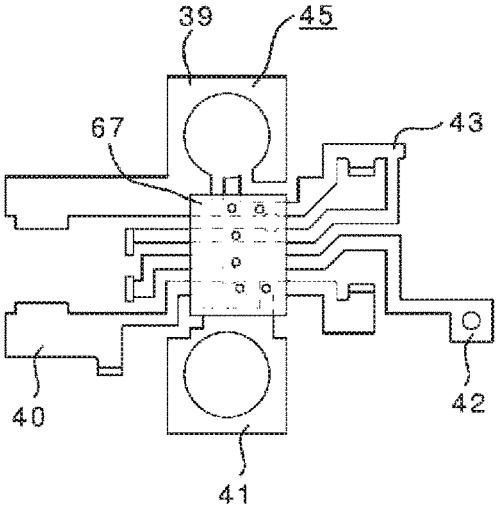
FIG. 14 is a plan view of the connector assembly, in the electromagnetic switch device for starter according to embodiment 1 of the present invention.
Figure 15:
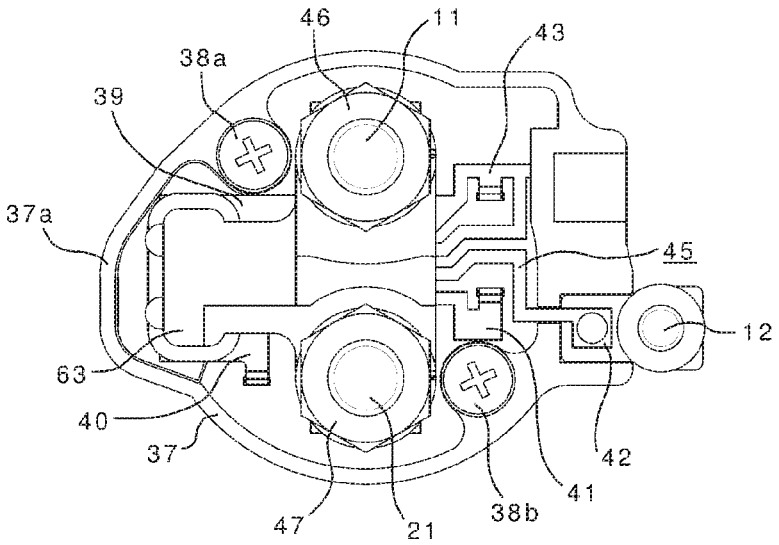
FIG. 15 is a side view of the electromagnetic switch device for starter according to embodiment 1 of the present invention before a liquid seal material is applied, as seen from the motor side (left side in FIG. 1).
Figure 16:
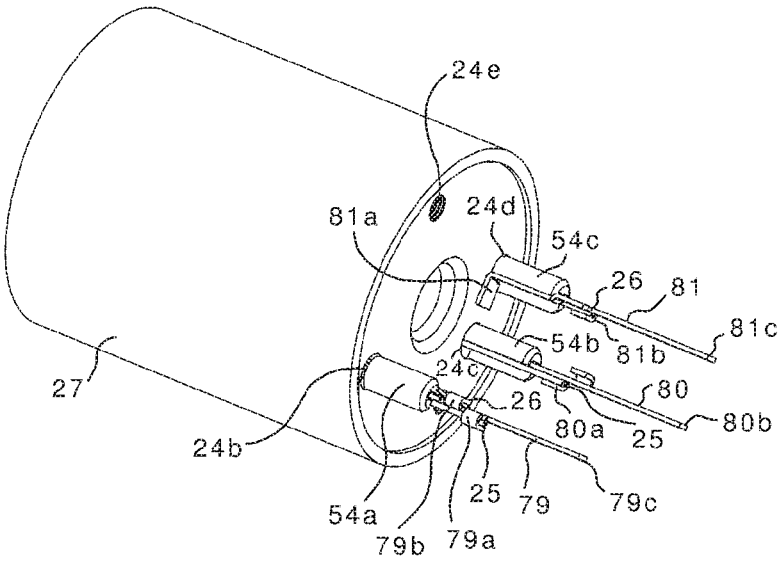
FIG. 16 is a perspective view showing a holding coil connection part of the electromagnetic switch device for starter according to embodiments 1 and 3 of the present invention.
Figure 17:
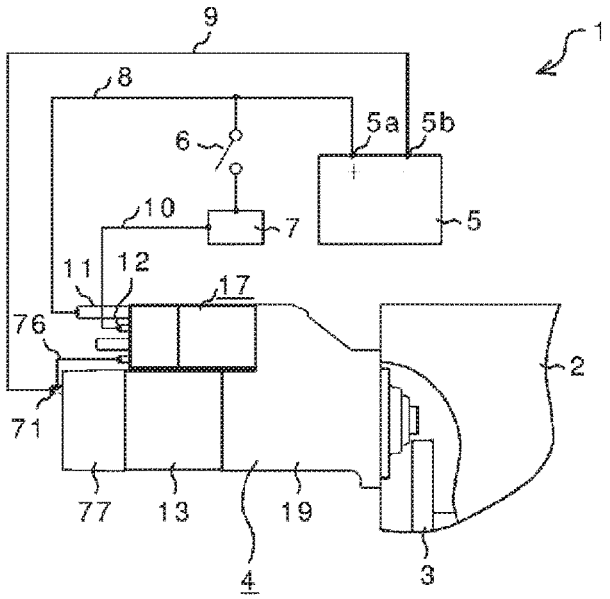
FIG. 17 is a schematic diagram of an internal combustion engine device according to embodiment 2 of the present invention.
Figure 18:
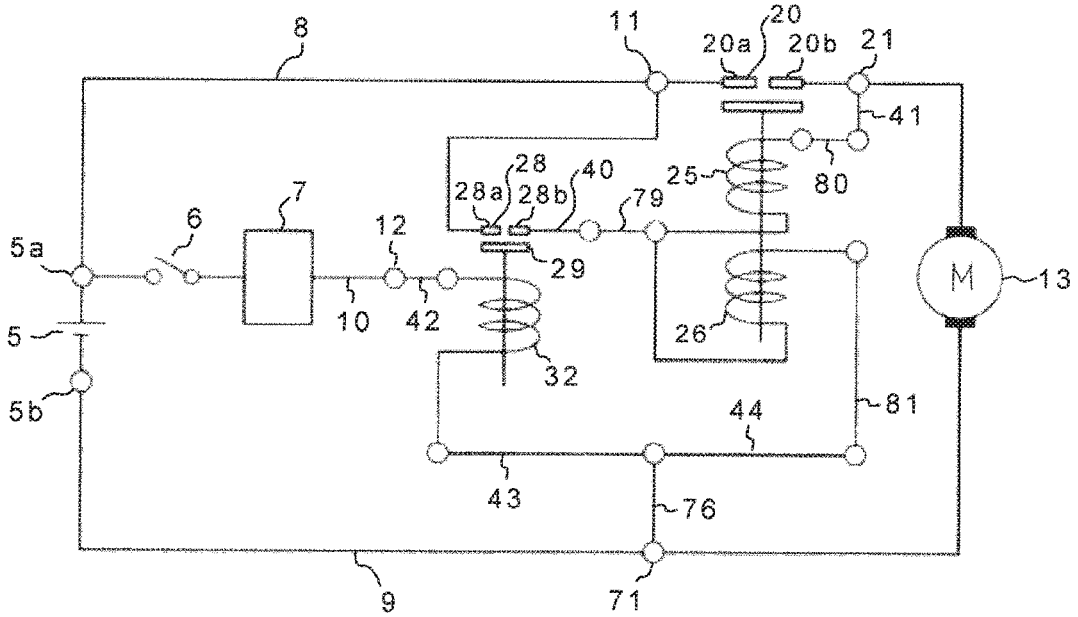
FIG. 18 is an electric circuit diagram of a starter provided with an electromagnetic switch device for starter according to embodiment 2 of the present invention.
Figure 19:
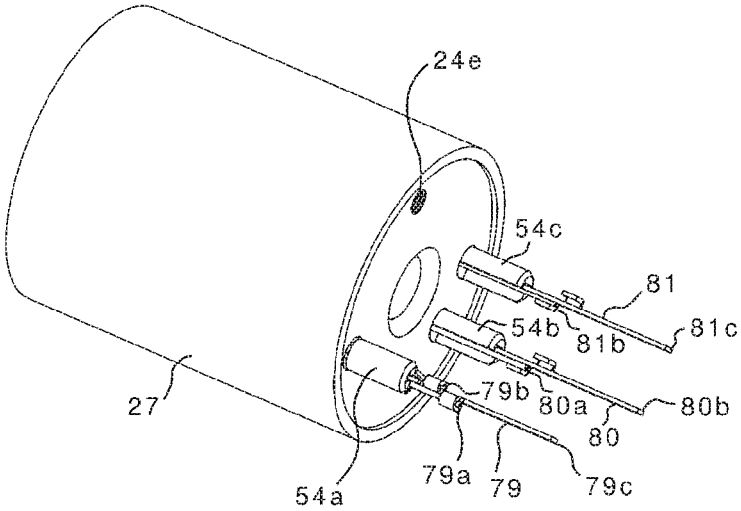
FIG. 19 is a perspective view showing a holding coil connection part according to embodiments 2 and 4 of the present invention.
Figure 20:
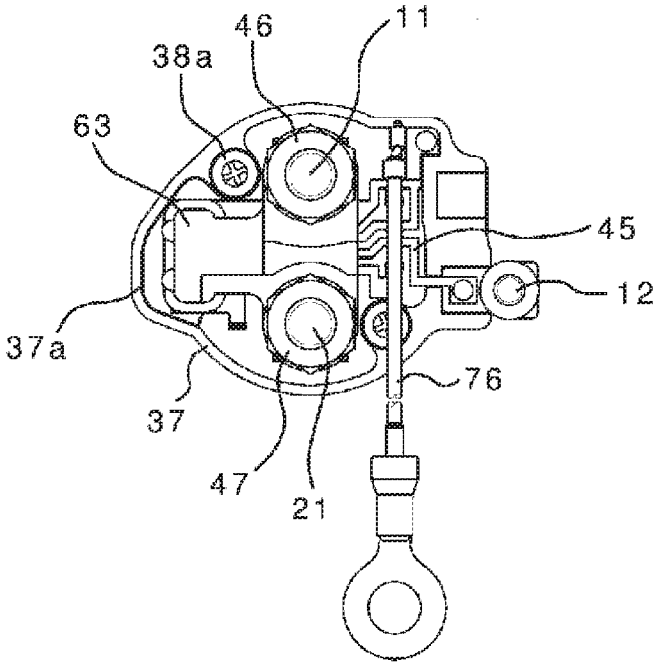
FIG. 20 is a side view of the electromagnetic switch device for starter according to embodiment 2 of the present invention before a liquid seal material is applied, as seen from the motor side (left side in FIG. 1).
Figure 21:
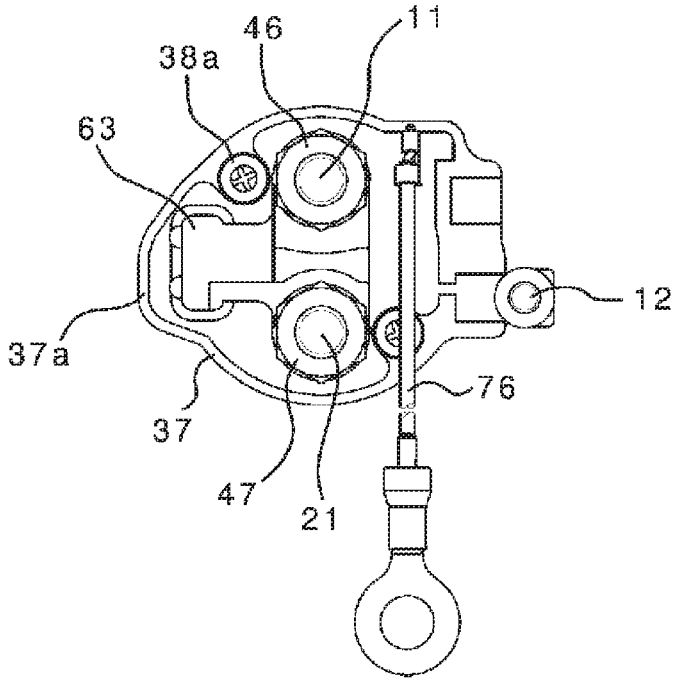
FIG. 21 is a side view of the electromagnetic switch device for starter according to embodiment 2 of the present invention after the liquid seal material is applied, as seen from the motor side (left side in FIG. 1).
Figure 22:
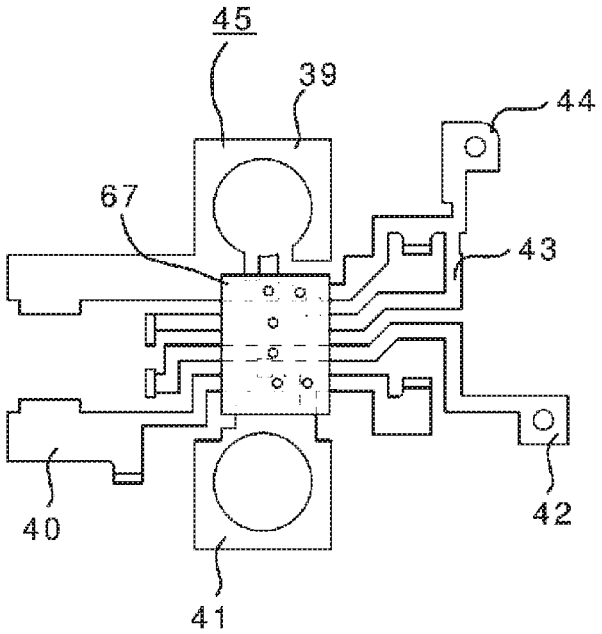
FIG. 22 is a plan view of a connector assembly of the electromagnetic switch device for starter according to embodiment 2 of the present invention.
Figure 23:
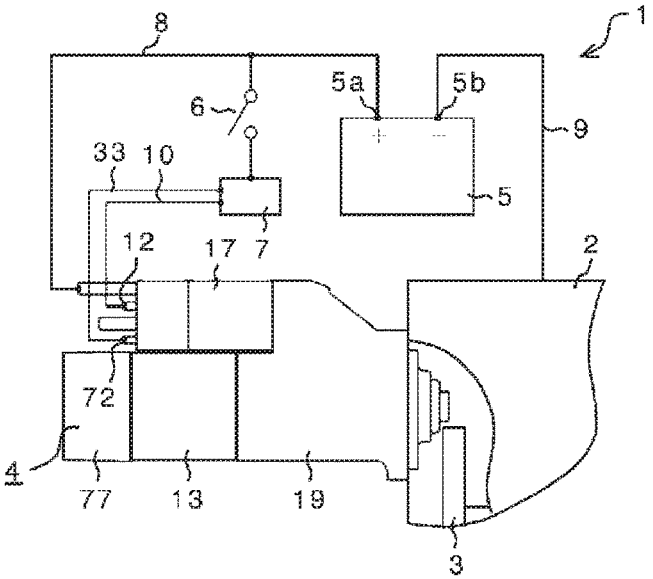
FIG. 23 is a schematic diagram of an internal combustion engine device according to embodiment 3 of the present invention.
Figure 24:
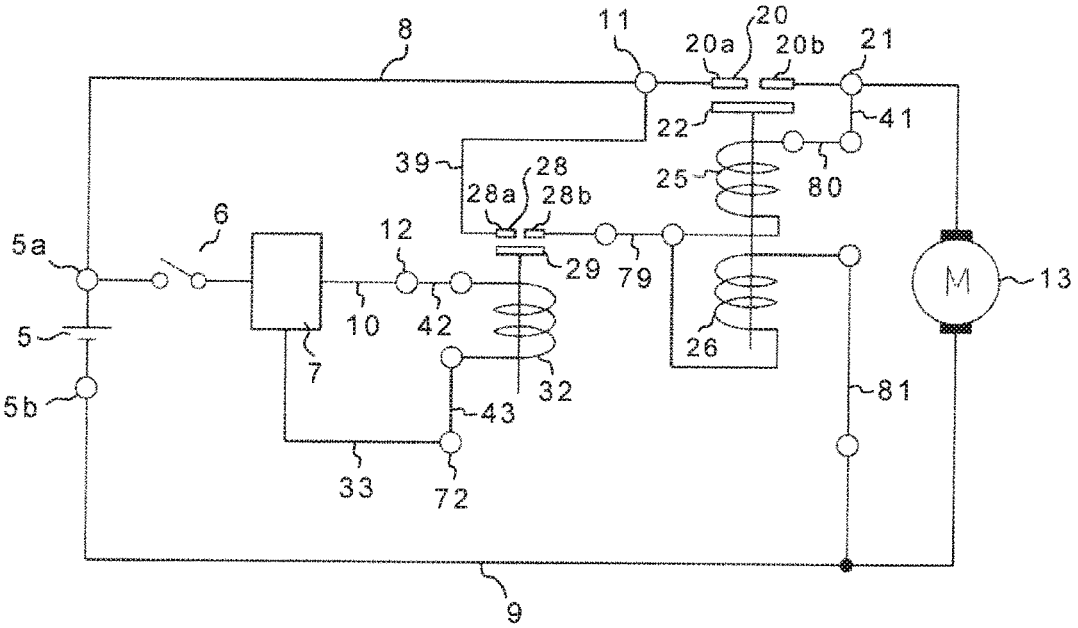
FIG. 24 is an electric circuit diagram of a starter provided with an electromagnetic switch device for starter according to embodiment 3 of the present invention.

For mass production, in general, a plurality of connector assemblies 45 are formed on one sheet material or are formed in series on a hoop material obtained by rolling a sheet material in a coil shape. FIGS. 12, 13 in the present embodiment 1 show a part of the hoop material on which the connector assemblies 45 are formed.

A liquid seal material 68 is a liquid seal material that has an insulating function and a rustproof function and can be hardened by temperature, moisture, ultraviolet rays, or the like after being applied. After the connector (A) 39, the connector (B) 40, the connector (C) 41, the connector (D) 42, and the connector (E) 43 are respectively connected to the counterpart members, the liquid seal material 68 is applied to the surfaces of the connector (A) 39, the connector (B) 40, the connector (C) 41, the connector (D) 42, and the connector (E) 43, and the surrounding area thereof.

O rings 66 are provided between the battery terminal 11 and the metal bush (A) 64 and between the motor terminal 21 and the metal bush (B) 65, to prevent water from entering a contact area between the connector (A) 39 and the metal bush (B) 64, a contact area between the connector (C) 41 and the metal bush (B) 65, and the main contact chamber 34, from outside.

The S terminal 12 is made of a conductive material and forms an electric circuit for the sub coil 32.

The S terminal 12 has a screw, a portion to be connected with the connector (D) 42, and a portion to be fitted to the terminal block 37. The S circuit (+) wire 10 is fastened to the screw by a nut (not shown) being screwed. The portion to be fitted to the terminal block 37 is provided in order to prevent the S terminal 12 from rotating by torque at the time of the screwing.

Figure 5:
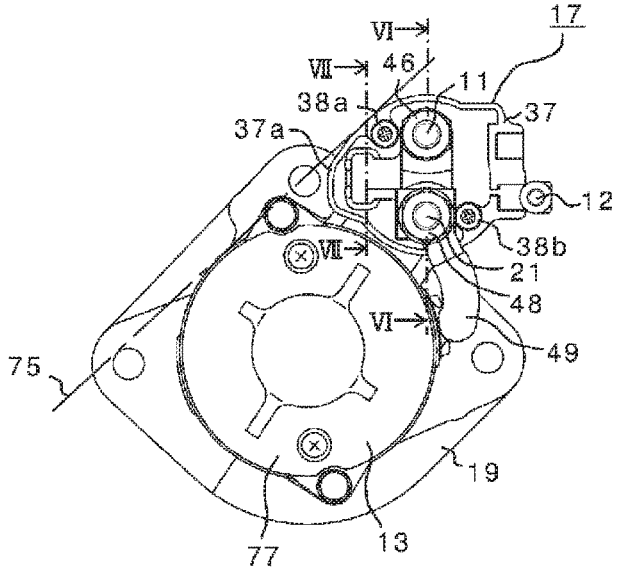
FIG. 5 is a side view of the electromagnetic switch device for starter according to embodiment 1 of the present invention, as seen from the motor side (left side in FIG. 1).
Figure 6:
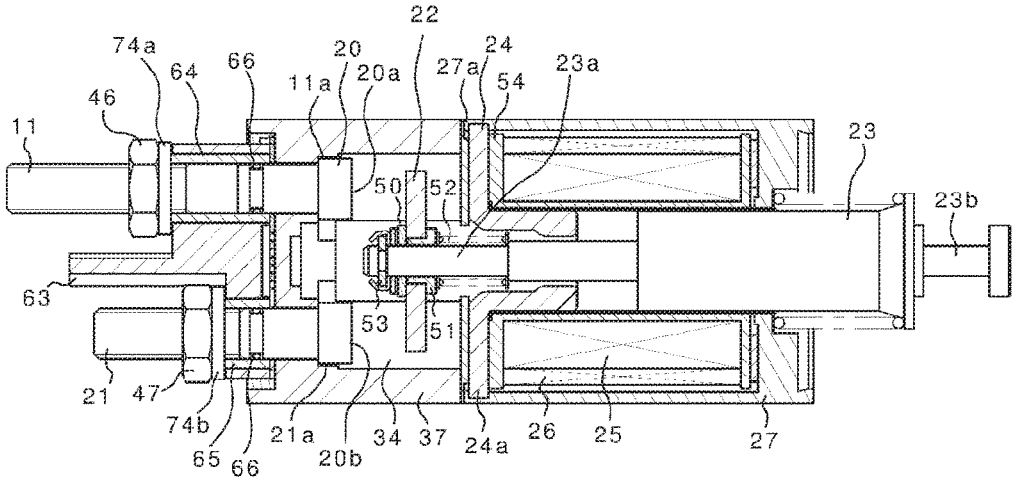
FIG. 6 is a sectional view of the electromagnetic switch device for starter according to embodiment 1 of the present invention, along VI-VI line in FIG. 5.
Figure 7:
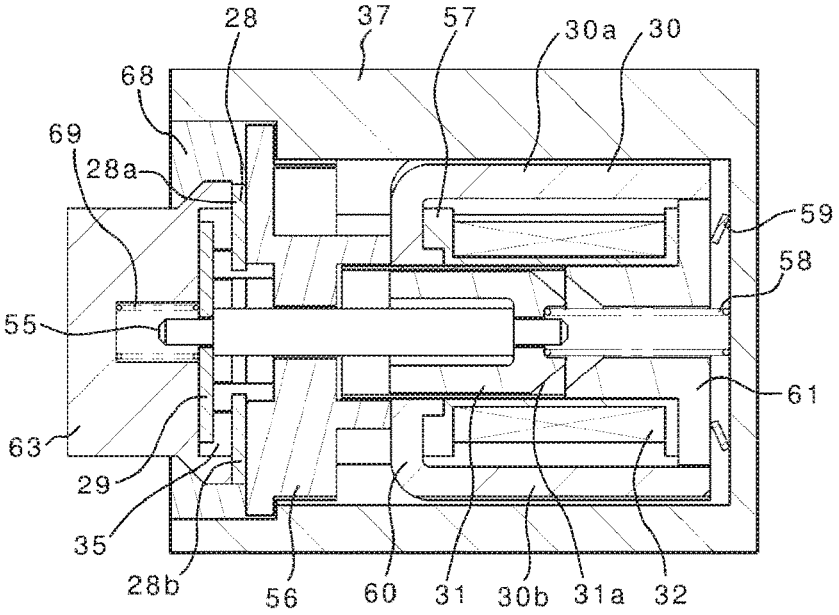
FIG. 7 is a sectional view around a terminal block of the electromagnetic switch device for starter according to embodiment 1 of the present invention, along VII-VII line in FIG. 5.

In FIG. 5, the S terminal 12 is located at the right of a line connecting the centers of the battery terminal 11 and the motor terminal 21 (whereas the sub coil 32 is located at the left).

The terminal (A) 79 is made of a plate-shaped conductive material, and fitted and fixed to the lead-out portion 54*a* of the bobbin 54.

The terminal (A) 79 connects the connector (B) 40, the attraction coil 25, and the holding coil 26.

The connection with the connector (B) 40 is made by welding and fixing the connector (B) 40 and an end portion 79*c*, the connection with the attraction coil 25 is made by welding and fixing the attraction coil 25 and a U-bent portion 79*a*, and the connection with the holding coil 26 is made by welding and fixing the holding coil 26 and a U-bent portion 79*b*.

The terminal (B) 80 is the same component as the terminal (A) 79. The terminal (B) connects the connector (C) 41 and the attraction coil 25.

The connection with the connector (C) 41 is made by welding and fixing the connector (C) 41 and an end portion 80*b*, and the connection with the attraction coil 25 is made by welding and fixing the attraction coil 25 and a U-bent portion 80*a*.

The terminal (C) 81 is made of a plate-shaped conductive material. The terminal (C) 81 connects the main fixed core 24, the connector (E) 43, and the holding coil 26.

The connection with the main fixed core 24 is made by welding and fixing the main fixed core 24 and an L-bent portion 81*a*, the connection with the connector (E) 43 is made by welding and fixing the connector (E) 43 and an end portion 81*c*, and the connection with the holding coil 26 is made by welding and fixing the holding coil 26 and a U-bent portion 81*b*.

In the electromagnetic switch device 17 for starter configured as described above, the protruding portion 37*a* of the terminal block 37 is located on the inner side with respect to a tangent line 75 connecting the outer circumference of the main yoke 27 and the outer circumference of the motor 13 (see FIG. 5).

Next, operation of the electromagnetic switch device 17 for starter will be described. When the key switch 6 is turned on and voltage is applied to the S terminal 12 via the S circuit (+) wire 10 from the control device 7, current flows through the sub coil 32.

The current flowing through the sub coil 32 is about several hundred mA to several A, and is ON/OFF-controlled by a contact relay or a semiconductor relay in the control device 7.

When current flows through the sub coil 32, a magnetic field is generated and a magnetic flux flows through a magnetic circuit formed by the sub yoke 30, the sub fixed core (A) 60, the sub fixed core (A) 60, the sub movable core 31, and gaps among these components.

Between the sub fixed core (B) 61 and the sub movable core 31, an inter-core gap exists which corresponds to the sum of values considering an inter-contact gap between the sub movable contact 29 and the pair of sub fixed contacts 28, manufacturing variation, and the like. The magnetic flux flowing through the magnetic circuit causes an attraction force that moves the sub movable core 31 toward the sub fixed core (B) 61 so that the inter-core gap reduces.

At one end side, of the sub movable core 31, opposite to its surface opposed to the sub fixed core (B) 61, the rod 55, the sub movable contact 29, and a sub contact spring 69 are arranged in this order. Therefore, when the sub movable core 31 moves toward the sub fixed core (B) 61, the sub movable contact 29 moves toward the pair of sub fixed contacts 28, due to a load by the sub contact spring 69.

When the inter-contact gap between the sub movable contact 29 and the pair of sub fixed contacts 28 disappears, the electric circuit for the attraction coil 25 and the holding coil 26 is closed, so that current flows through the attraction coil 25 and the holding coil 26.

Also after current flows through the attraction coil 25 and the holding coil 26, current continues to flow through the sub coil 32. Therefore, the sub movable core 31 continues to move until the sub movable core 31 comes into contact with the sub fixed core (B) 61, and after the sub movable core 31 comes into contact with the sub fixed core (B) 61, the sub movable core 31 is held in this state.

When current flows through the attraction coil 25 and the holding coil 26, a magnetic field is generated and a magnetic flux flows through a magnetic circuit formed by the main yoke 27, the main fixed core 24, the main movable core 23, and gaps among these components.

Between the main fixed core 24 and the main movable core 23, an inter-core gap exists which corresponds to the sum of values considering an inter-contact gap between the main movable contact 22 and the pair of main fixed contacts 20, a deflection margin of the main contact spring 52, manufacturing variation, and the like. The magnetic flux flowing through the magnetic circuit causes an attraction force that moves the main movable core 23 to the main fixed core 24 so that the inter-core gap reduces.

Since the main movable contact 22 is located at one end of the main movable core 23, the main movable core 23 moves toward the pair of main fixed contacts 20, and the main movable contact 22 comes into contact with the pair of main fixed contacts 20. As a result, the motor circuit is closed, whereby voltage is applied to the motor terminal 21 and the motor 13 starts to rotate.

One end of the attraction coil 25 is electrically connected to one end of the pair of sub fixed contacts 28, and the other end of the attraction coil 25 is electrically connected to the motor terminal 21. Therefore, at the same time as the pair of main fixed contacts 20 and the main movable contact 22 come into contact with each other and voltage is applied to the motor terminal 21, a potential difference between both ends of the attraction coil 25 almost disappears. Therefore, after a transient phenomenon has finished, almost no current flows through the attraction coil 25.

The main movable core 23 continues to move until the main movable core 23 comes into contact with the main fixed core 24, by an inertial force of the main movable core 23 itself, transient current of the attraction coil 25, and current of the holding coil 26.

After the main movable core 23 and the main fixed core 24 come into contact with each other, the inter-core gap disappears, and therefore the amount of magnetic flux needed for holding is significantly reduced, and the main movable core 23 and the main fixed core 24 are held in a contact state by the holding force by the holding coil 26.

Through a process in which the main movable core 23 is attracted to the main fixed core 24, the pinion 16 is moved toward the ring gear 3 by the shift lever 18 connected with the main movable core 23, and the pinion 16 and the ring gear 3 are engaged with each other by their tooth flanks, whereby torque generated by the motor 13 is transmitted from the pinion 16 to the ring gear 3.

The pinion 16 and the ring gear 3 are toothed gears, and sometimes the end surfaces of their teeth collide with each other, so that the pinion 16 and the ring gear 3 are not engaged by their tooth flanks. In this state, the pair of main fixed contacts 20 and the main movable contact 22 do not come into contact with each other. However, in the auxiliary-rotation-type starter in the present embodiment 1, since one end of the attraction coil 25 is connected to the motor terminal 21, the motor 13 rotates by current of the attraction coil 25, and when the pinion 16 rotates to such a position where engagement by the tooth flanks becomes possible, the pinion 16 starts to advance again to make engagement by the tooth flanks, so that the pair of main fixed contacts 20 and the main movable contact 22 come into contact with each other.

Although not described in the embodiments of the present invention, in the case of an electromagnetic push type starter, the main movable core 23 continues to move by an engagement spring provided in the main movable core 23, the pair of main fixed contacts 20 and the main movable contact 22 thus come into contact with each other, and then the motor 13 rotates, whereby the pinion 16 rotates to such a position where the pinion 16 and the ring gear 3 can be engaged with each other by their tooth flanks, and thus the engagement by the tooth flanks is made.

When the motor 13 rotates, the engine 2 starts to rotate via the pinion 16 and the ring gear 3.

When the engine 2 reaches such a rotation speed that allows self-rotation, the engine 2 starts self-rotation. The operation when the starter 4 starts to rotate the engine 2 is as described above.

Hereinafter, operation when the starter 4 stops after the engine 2 starts self-rotation will be described. It is noted that the starter 4 performs the same stop operation also when an operator of the key switch 6 turns off the key switch 6 before the engine 2 starts self-rotation, or when the control device 7 itself determines that starting need not be performed or is impossible.

After the engine 2 starts self-rotation, operation of the starter 4 is not necessary any longer, and therefore, an operator of the key switch 6 turns off the key switch 6 or the control device 7 itself performs determination to stop voltage application to the S terminal 12.

When the voltage application to the S terminal 12 is stopped, current does not flow through the sub coil 32 any longer. As a result, the holding force between the sub movable core 31 and the sub fixed core (B) 61 disappears, and by a force of the sub return spring 58, the sub movable core 31 moves away from the sub fixed core (B) 61 to return to the original position.

Through this process, the sub movable contact 29 receives a force in a direction away from the pair of sub fixed contacts 28 via the rod 55 and is thus separated from the pair of sub fixed contacts 28, so that the electric circuit for the attraction coil 25 and the holding coil 26 is opened and current does not flow through the attraction coil 25 and the holding coil 26 any longer.

When current does not flow through the attraction coil 25 and the holding coil 26, the force for holding the main movable core 23 to the main fixed core 24 disappears, and the main movable core 23 returns to the original position by a force of a main return spring 70. Through this process, the main movable contact 22 is separated from the pair of main fixed contacts 20 and thus the motor circuit is opened, so that current does not flow through the motor 13 any longer and rotation of the motor 13 is stopped.

In addition, through this process, the pinion 16 is returned to the original position by the shift lever 18 connected with the main movable core 23, and the pinion 16 is disengaged from the ring gear 3.

The stop operation of the starter 4 is as described above.

In the electromagnetic switch device 17 for starter configured as described above, the main contact chamber 34 and the sub coil 32 are arranged so as to be separated from each other in the radial direction with the partition wall 36 provided therebetween in the terminal block 37, whereby the winding frame diameter of the sub coil 32 can be minimized and thus the sub coil 32 can be downsized.

That is, in the case where the sub coil 32 is provided coaxially with the main movable core 23 as in Patent Documents 1 to 3, the bobbin 57 is provided around the outer circumference of the main movable contact 22 and the shaft 23*a* to which the main movable contact 22 is fixed, so as to avoid interference therewith, and therefore the outer diameter of the winding frame (bobbin 57) increases. In contrast, in the case where the sub coil 32 is provided in parallel with the main contact chamber 34 as in embodiment 1 of the present invention, the outer shape of the component penetrating through the inside of the bobbin 57 is small, and therefore the sub coil 32 can be downsized.

In addition, since there is no protrusion in the axial direction, vehicle mountability is improved and vibration resistance is also improved, and since the main contact chamber 34 and the sub contact chamber 35 are separated from each other, contact powder generated in each contact chamber does not transfer to the other contact chamber.

In addition, since the connector (A) 39, the connector (B) 40, the connector (C) 41, the connector (D) 42, and the connector (E) 43 are integrally fixed by the resin member 67, assembly work is easy, and the connector (A) 39, the connector (B) 40, the connector (C) 41, the connector (D) 42, and the connector (E) 43 can be set in a resin formation mold while being integrated via the support frame 45*b* and the tie bars 45*a*. Therefore, work for providing them to the resin formation mold is easy as compared to the case where they are separated from each other.

In addition, since the connector (A) 39 and the sub fixed contact 28*a* are formed by the same member and the connector (B) 40 and the sub fixed contact 28*b* are formed by the same member, work for connection between the connector (A) 39 and the sub fixed contact 28*a* and connection between the connector (B) 40 and the sub fixed contact 28*b* is not needed.

In addition, since the connector (A) 39, the connector (B) 40, the connector (C) 41, the connector (D) 42, and the connector (E) 43 which have conductive surfaces are subjected to insulation treatment after being assembled, it is not necessary to perform work for removing insulating materials at electric connection parts as in the case of using conductors having surfaces covered with insulating materials in advance, and meanwhile, the insulation condition can be kept excellent and the rustproof property of each electric connection part can be ensured.

In addition, since the sub yoke 30 is provided so as to avoid the partition wall 36 direction and the outermost circumferential direction of the terminal block 37, the protruding portion 37*a* of the terminal block 37 is small.

In addition, since the sub yoke 30 is integrated with the sub fixed core (A) 60 using the same member, the number of assembly components can be decreased.

In addition, since the sub coil 32 and the S terminal 12 are divided to left and right with respect to the center line passing through the battery terminal 11 and the motor terminal 21, the terminal block 37 is prevented from protruding only in one direction and such protrusions can be distributed to left and right.

In addition, since the sub coil accommodation portion of the terminal block 37 is located on the inner side with respect to the tangent line 75 connecting the outer circumferences of the motor 13 and the main yoke 27, the area projected in the axial direction is reduced and vehicle mountability is improved.

In addition, it is desirable that the main fixed contact 20*a* and the sub fixed contact 28*b* to which voltage is always applied are directed upward just in case that submergence or the like occurs. The center line of the pair of main fixed contacts 20 and the center line of the pair of sub fixed contacts 28 are designed in parallel to each other, whereby, if the main fixed contact 20*a* to which voltage is always applied is directed upward, the sub fixed contact 28*b* to which voltage is always applied can be also directed upward.

In addition, since the O rings 66 are provided around the outer circumferences of the battery terminal 11 and the motor terminal 21, an effect of improving the waterproof property is obtained.

Embodiment 2

Next, the configuration of an electromagnetic switch device for starter according to embodiment 2 will be described.

The internal combustion engine device 1 in embodiment 1 has a so-called body-ground configuration in which the connection surface of the engine 2 with the front bracket 19 of the starter 4 forms a ground circuit. Meanwhile, in some internal combustion engine devices, a ground-floating-type starter may be used in which there is no electric connection between the starter and the engine.

In this case, on the minus side of the motor circuit of the starter and the minus side of the electric circuit of the electromagnetic switch device for starter, a dedicated terminal (E terminal) and the battery minus terminal 5*b* are electrically connected.

Embodiment 2 is applied to such an internal combustion engine device. Here, points modified from embodiment 1 will be described.

In FIGS. 17 to 22, in the internal combustion engine device 1 in embodiment 2, in addition to the configuration of embodiment 1, an E terminal 71 is provided to the starter 4, and the connector (F) 44 and a holding coil minus wire 76 are provided to the electromagnetic switch device 17 for starter.

The E terminal 71 is a conductor and forms an electric circuit for the starter 4 and the electromagnetic switch device 17 for starter.

The E terminal 71 has a screw and is fixed to a rear bracket 77 with an insulating material (not shown) provided therebetween. The battery minus wire 9 and the holding coil minus wire 76 are fitted to the screw of the E terminal 71 and a nut is screwed thereto.

In embodiment 1, the L-bent portion 81*a* of the terminal (C) 81 is welded and fixed to the main fixed core 24, but in embodiment 2, the terminal (C) 81 is not welded and fixed to the main fixed core 24, and the same component as the terminal (A) 79 and the terminal (B) 80 is fitted and fixed to the bobbin 54.

There is no modification in the configuration in which the connector (E) 43 is welded to the end portion 81*c* of the terminal (C) 81 and the holding coil 26 is welded to the U-bent portion 81*b*.

The connector (F) 44 is formed by a member integrated with the connector (E) 43, and one end of the connector (F) 44 is connected to the holding coil minus wire 76 to be electrically connected to the battery minus terminal 5*b*.

The holding coil minus wire 76 is a copper wire having an insulating coat, and forms an electric circuit for the holding coil 26 and the sub coil 32.

One end of the holding coil minus wire 76 is connected to the connector (F) 44, and the other end thereof is connected to the E terminal 71.

The connector assembly 45 has a shape different from that in embodiment 1, but can be manufactured merely by changing the locations where the tie bars are cut in the state shown in FIG. 13 in embodiment 1.

The electromagnetic switch device for starter configured as described above can provide the same effect as in embodiment 1 even if the starter is of a ground floating type.

Embodiment 3

Next, the configuration of an electromagnetic switch device for starter according to embodiment 3 will be described.

In the electromagnetic switch device 17 for starter in embodiment 1, operation of the electromagnetic switch device for starter is controlled by opening and closing the circuit on the upstream side (S terminal 12 side) of the sub coil 32. In embodiment 3, operation of the electromagnetic switch device for starter is controlled by opening and closing the circuit on the minus side (connector (E) 43 side) of the sub coil 32. Thus, the control method in embodiment 1 is called a plus control method, whereas the control method in embodiment 3 is called a minus control method.

In FIG. 23 to FIG. 27, in addition to the configuration in embodiment 1 according to embodiment 2, the internal combustion engine device includes an S circuit (–) wire 33, and the electromagnetic switch device 17 for starter includes an E1 terminal 72.

In embodiment 1, the connector (E) 43 is connected to the terminal (C) 81, but in embodiment 3, the connector (E) 43 is connected to the E1 terminal 72, instead of being connected to the terminal (C).

The E1 terminal 72 is made of a conductive material and forms an electric circuit for the sub coil 32.

The E1 terminal 72 has a screw, a portion to be connected with the connector (E) 43, and a portion to be fitted to the terminal block 37. The S circuit (–) wire 33 is fastened to the screw of the E1 terminal 72 by a nut (not shown) being screwed. A fitting portion is provided to the terminal block 37 in order to prevent the E1 terminal 72 from rotating by torque at the time of the screwing.

Figure 25:
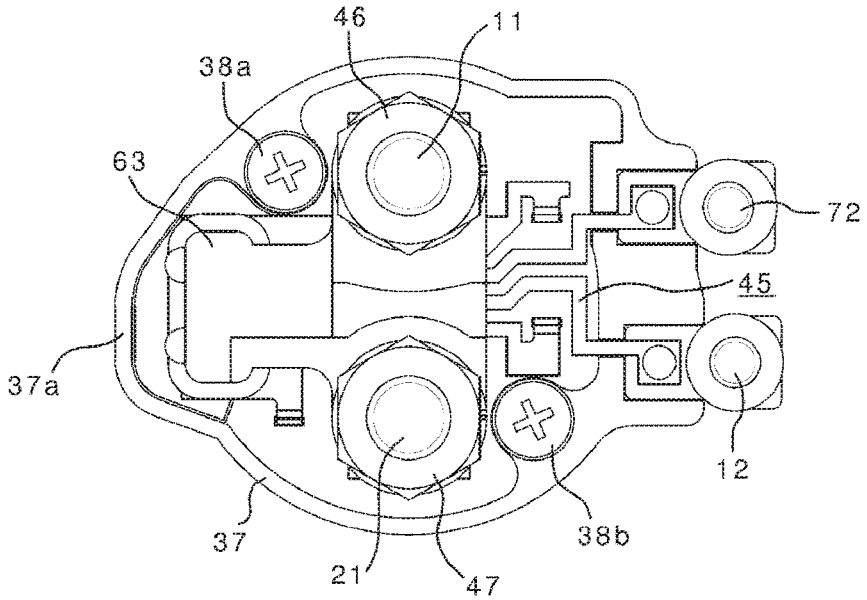
FIG. 25 is a side view of the electromagnetic switch device for starter according to embodiment 3 of the present invention before a liquid seal material is applied, as seen from the motor side (left side in FIG. 1).
Figure 26:
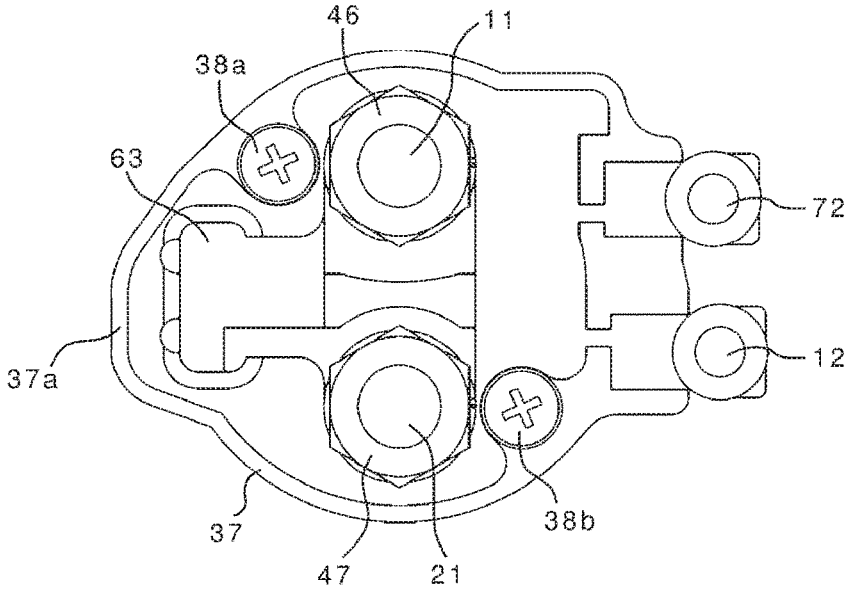
FIG. 26 is a side view of the electromagnetic switch device for starter according to embodiment 3 of the present invention after the liquid seal material is applied, as seen from the motor side (left side in FIG. 1).
Figure 27:
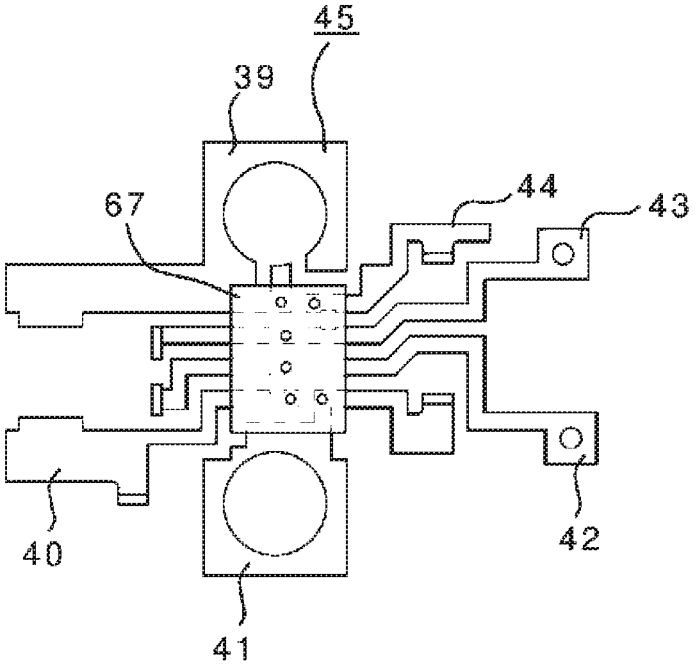
FIG. 27 is a plan view of a connector assembly of the electromagnetic switch device for starter according to embodiment 3 of the present invention.
Figure 28:
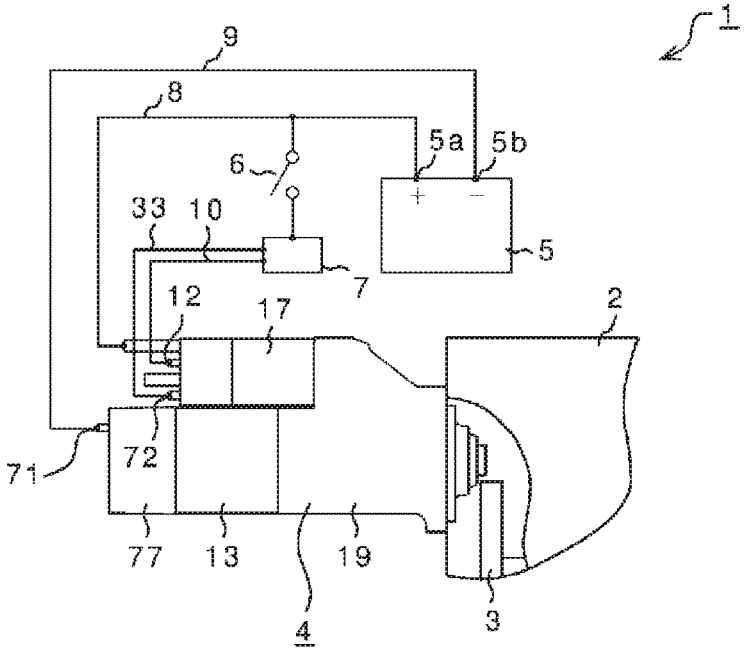
FIG. 28 is a schematic diagram of an internal combustion engine device according to embodiment 4 of the present invention.
Figure 29:
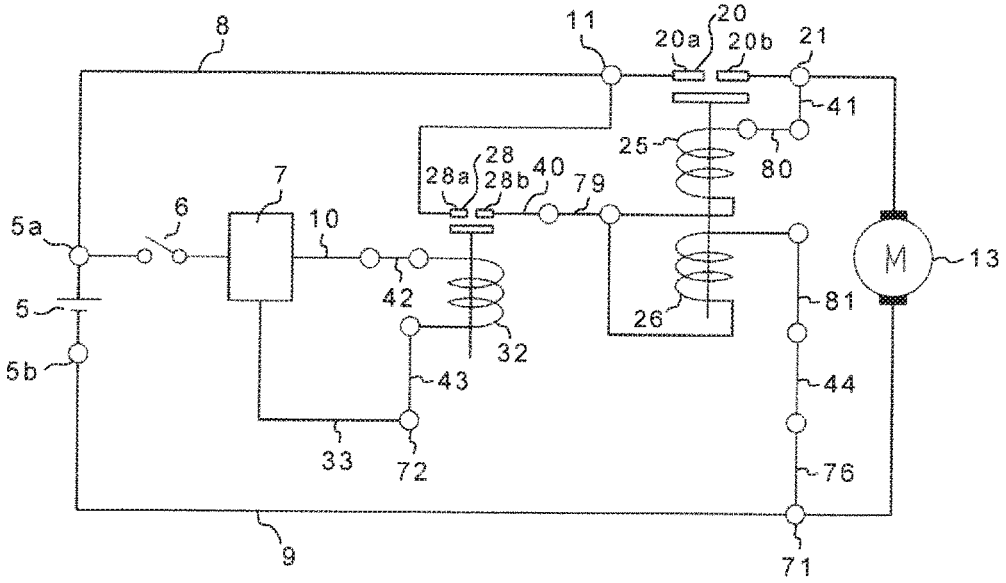
FIG. 29 is an electric circuit diagram of a starter provided with an electromagnetic switch device for starter according to embodiment 4 of the present invention.

The fitting portions of the E1 terminal 72 and the terminal block 37 are located at the right of a line connecting the centers of the battery terminal 11 and the motor terminal 21 (whereas the sub coil 32 is located at the left) (see FIGS. 25, 26).

The connector assembly 45 has a shape different from that in embodiment 1, but can be manufactured merely by changing the locations where the tie bars are cut in the state shown in FIG. 13 in embodiment 1.

The electromagnetic switch device for starter configured as described above can provide the same effect as in embodiment 1 even if the starter is of a minus control type.

Embodiment 4

Next, the configuration of an electromagnetic switch device for starter according to embodiment 4 will be described.

The electromagnetic switch device for starter in embodiment 4 uses a ground-floating-type starter as in embodiment 2 and uses a minus control method as in embodiment 3.

In FIG. 28 to FIG. 32, in addition to the configuration in embodiment 1, the internal combustion engine device 1 includes the S circuit (–) wire 33; the E terminal 71 is provided to the starter 4; and the E1 terminal 72, the connector (F) 44, and the holding coil minus wire 76 are provided to the electromagnetic switch device 17 for starter.

The E terminal 71 is a conductor and forms an electric circuit for the starter 4 and the electromagnetic switch device 17 for starter. The E terminal 71 has a screw and is fixed to the rear bracket 77 with an insulating material provided therebetween. The battery minus wire 9 and the holding coil minus wire 76 are fitted to the screw and a nut is screwed thereto.

In embodiment 1, the connector (E) 43 is connected to the terminal (C) 81, but in embodiment 4, the connector (E) 43 is connected to the E1 terminal 72, instead of being connected to the terminal (C) 81.

The E1 terminal 72 is made of a conductive material and forms an electric circuit for the sub coil 32.

The E1 terminal 72 has a screw, a portion to be connected with the connector (E) 43, and a portion to be fitted to the terminal block 37. The S circuit (–) wire 33 is fastened to the screw of the E1 terminal 72 by a nut (not shown) being screwed. A fitting portion is provided to the terminal block 37 in order to prevent the E1 terminal 72 from rotating by torque at the time of the screwing.

Figure 30:
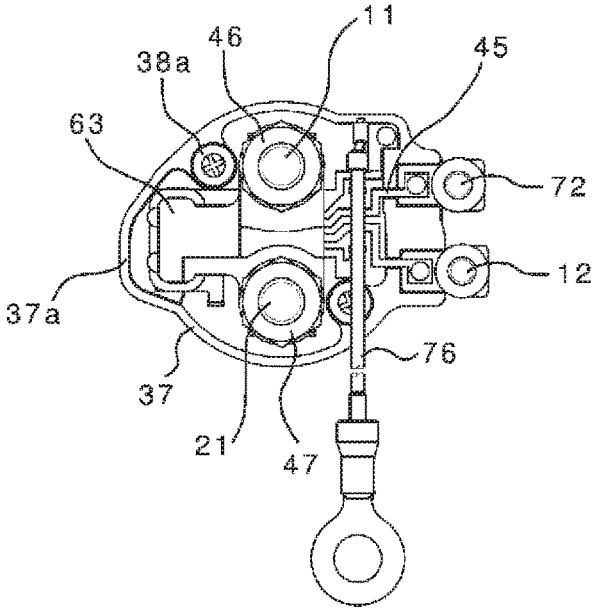
FIG. 30 is a side view of the electromagnetic switch device for starter according to embodiment 4 of the present invention before a liquid seal material is applied, as seen from the motor side (left side in FIG. 1).
Figure 31:
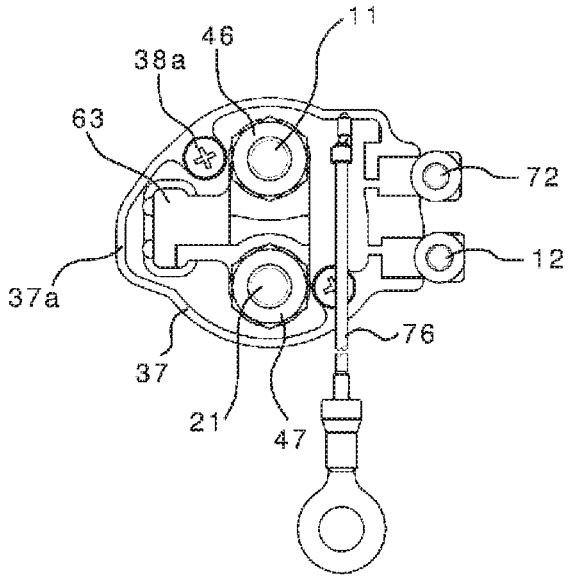
FIG. 31 is a side view of the electromagnetic switch device for starter according to embodiment 4 of the present invention after the liquid seal material is applied, as seen from the motor side (left side in FIG. 1).
Figure 32:
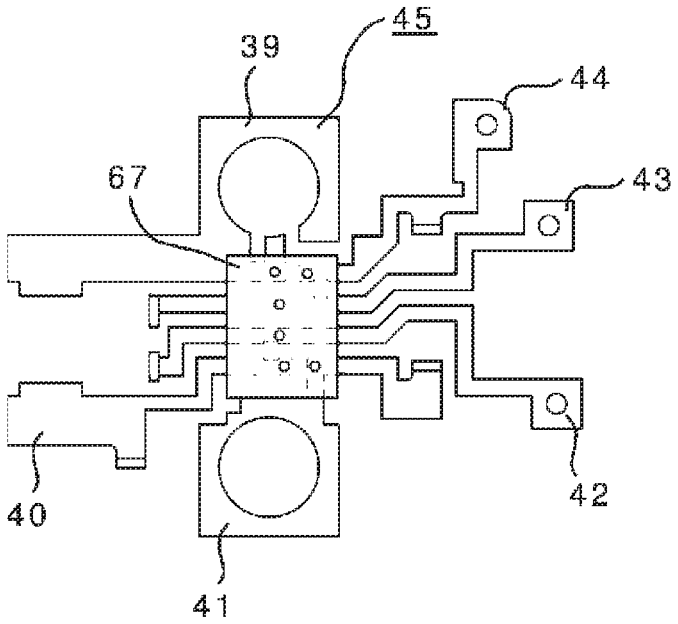
FIG. 32 is a plan view of a connector assembly of the electromagnetic switch device for starter according to embodiment 4 of the present invention.

The fitting portions of the E1 terminal 72 and the terminal block 37 are located at the right of a line connecting the centers of the battery terminal 11 and the motor terminal 21 (whereas the sub coil 32 is located at the left) (see FIGS. 30, 31).

In embodiment 1, the L-bent portion 81*a* of the terminal (C) 81 is welded and fixed to the main fixed core 24, but in embodiment 4, as in embodiment 2, the terminal (C) 81 is not welded and fixed to the main fixed core 24, and the same component as the terminal (A) 79 and the terminal (B) 80 is fitted and fixed to the bobbin 54.

There is no modification in the configuration in which the connector (E) 43 is welded to the end portion 81*c* of the terminal (C) 81 and the holding coil 26 is welded to the U-bent portion 81*b*.

The connector (F) 44 is formed by a member integrated with the connector (E) 43, and one end of the connector (F) 44 is connected to the holding coil minus wire 76 to be electrically connected to the battery minus terminal 5*b*.

The holding coil minus wire 76 is a copper wire having an insulating coat, and forms an electric circuit for the holding coil 26 and the sub coil 32.

One end of the holding coil minus wire 76 is connected to the connector (F) 44, and the other end thereof is connected to the E terminal 71.

The connector assembly 45 has a shape different from that in embodiment 1, but can be manufactured merely by changing the locations where the tie bars are cut in the state shown in FIG. 13 in embodiment 1.

The electromagnetic switch device for starter configured as described above can provide the same effect as in embodiment 1 even if the starter is of a ground floating type and of a minus control type.

It is noted that, within the scope of the present invention, the above embodiments may be freely combined with each other, or each of the above embodiments may be modified or simplified as appropriate.

DESCRIPTION OF THE REFERENCE CHARACTERS

1 internal combustion engine device
2 engine
3 ring gear
4 starter
5 battery
5*a* battery plus terminal
5*b* battery minus terminal
6 key switch
7 control device
8 battery plus wire
9 battery minus wire
10 S circuit (+) wire
11 battery terminal
11*a* side surface
12 S terminal
13 motor
14 output shaft
15 overrunning clutch
16 pinion
17 electromagnetic switch device for starter
18 shift lever
19 front bracket
20 pair of main fixed contacts

20*a*, 20*b* main fixed contact
21 motor terminal
22 main movable contact
23 main movable core
23*a* small-diameter portion
23*b* hook-shaped portion
24 main fixed core
24*a* flange portion
24*b* to 24*d* through hole
24*e* screw hole
25 attraction coil
26 holding coil
27 main yoke
28 pair of sub fixed contacts
28*a*, 28*b* sub fixed contact
29 sub movable contact
30 sub yoke
31 sub movable core
31*a* taper surface
32 sub coil
33 S circuit (−) wire
34 main contact chamber
35 sub contact chamber
36 partition wall
37 terminal block
37*a* protruding portion
38*a*, 38*b* bolt
39 connector (A)
40 connector (B)
41 connector (C)
42 connector (D)
43 connector (E)
44 connector (F)
45 connector assembly
45*a* tie bar
45*b* support frame
46 nut
47 nut
48 nut
49 motor wire
50 insulating plate
51 insulating member
52 main contact spring
53 fastening ring
54 bobbin
54*a*, 54*b*, 54*c* lead-out portion
55 rod
56 spacer
57 bobbin
58 sub return spring
59 gap adjustment spring
60 sub fixed core (A)
61 sub fixed core (B)
63 cover
64 metal bush (A)
65 metal bush (B)
66 O ring
67 resin member
68 liquid seal material
69 sub contact spring
70 main return spring
71 E terminal
72 E1 terminal
74*a*, 74*b* washer
75 tangent line
76 holding coil minus wire
77 rear bracket
79 terminal (A)
79*a*, 79*b* U-bent portion
79*c* end portion
80 terminal (B)
80*a* U-bent portion
80*b* end portion
81 terminal (C)
81*a* L-bent portion
81*b* U-bent portion
81*c* end portion

The invention claimed is:

1. An electromagnetic switch device for starter, comprising:

an electromagnetic switch which includes a pair of main fixed contacts, a main movable contact, an attraction coil, and a holding coil and which opens and closes an electric circuit for a motor via the pair of main fixed contacts, and when the attraction coil and the holding coil are energized, moves an overrunning clutch via a shift lever;

an auxiliary relay which includes a pair of sub fixed contacts, a sub movable contact, and a sub coil, the pair of sub fixed contacts being connected to the attraction coil and the holding coil of the electromagnetic switch, the auxiliary relay energizing the attraction coil and the holding coil of the electromagnetic switch via the pair of sub fixed contacts in response to a starting signal; and a connector assembly which includes a plurality of connectors formed by stamping a conductive material, and which forms the motor electric circuit and an electric circuit for supplying power to the attraction coil and the holding coil, wherein the connector assembly includes a connector (A) connecting one of the pair of sub fixed contacts, and a battery terminal to be connected to a battery, a connector (B) connecting the other one of the pair of sub fixed contacts, and one end of the attraction coil and one end of the holding coil, a connector (C) connecting the other end of the attraction coil and a motor terminal to be connected to the motor, a connector (D) connecting one end of the sub coil and an S terminal, and a resin member integrally fixing at least one pair of the connector (A), the connector (B), the connector (C), and the connector (D).

2. An electromagnetic switch device for starter, comprising:

a pair of main fixed contacts which form a motor electric circuit for supplying power to a motor and are located at positions electrically and mechanically separated from each other;

a battery terminal having an end at which one of the pair of main fixed contacts is formed, and another end to which a wire electrically connected to a plus terminal of a battery is fixed;

a motor terminal having an end at which the other one of the pair of main fixed contacts is formed, and another end to which a wire connected to the motor is fixed;

a main movable contact which forms the motor electric circuit by electrically connecting the pair of main fixed contacts;

a main movable core which is made of a magnetic material and moves the main movable contact toward the pair of main fixed contacts;

a main fixed core which is made of a magnetic material and generates an attraction force between the main movable core and the main fixed core;

an attraction coil which generates a magnetic field for attracting the main movable core to the main fixed core;

a holding coil which generates a magnetic field for holding the main movable core at a movement end after the attraction;

a main yoke which is made of a magnetic material and serves as a magnetic circuit for the magnetic field generated by the attraction coil and the holding coil;

a pair of sub fixed contacts which form an electric circuit for supplying power to the attraction coil and the holding coil and are located at positions electrically and mechanically separated from each other;

a sub movable contact which forms an electric circuit for supplying power to the attraction coil and the holding coil, by electrically connecting the pair of sub fixed contacts;

a sub movable core which is made of a magnetic material and generates a propulsive force for moving the sub movable contact toward the pair of sub fixed contacts;

a sub coil which generates a magnetic field as a base for the propulsive force of the sub movable core;

a sub yoke serving as a magnetic circuit for the magnetic field of the sub coil;

a pair of sub fixed cores located at both ends of the sub yoke and serving as a magnetic circuit;

a main contact chamber forming a space in which the pair of main fixed contacts are located and the main movable contact can move;

a sub contact chamber forming a space in which the pair of sub fixed contacts are located and the sub movable contact can move; and a connector assembly which includes a plurality of connectors formed by stamping a conductive material, and which forms the motor electric circuit and an electric circuit for supplying power to the attraction coil and the holding coil, wherein the connector assembly includes a connector (A) connecting one of the pair of sub fixed contacts, and the battery terminal, a connector (B) connecting the other one of the pair of sub fixed contacts, and one end of the attraction coil and one end of the holding coil, a connector (C) connecting the other end of the attraction coil and the motor terminal, a connector (D) connecting one end of the sub coil and an S terminal, and a resin member integrally fixing at least one pair of the connector (A), the connector (B), the connector (C), and the connector (D).

3. The electromagnetic switch device for starter according to claim 1, wherein at least one pair of the connector (A), the connector (B), the connector (C), and the connector (D) are formed by the same material and integrally fixed with the resin member, and thereafter are separated by tie bars being cut.

4. The electromagnetic switch device for starter according to claim 1, wherein either a set of the connector (A) and one of the pair of sub fixed contacts, or a set of the connector (B) and the other one of the pair of fixed contacts, are formed by the same member.

5. The electromagnetic switch device for starter according to claim 1, wherein the connector (A), the connector (B), the connector (C), and the connector (D) have conductive surfaces and are subjected to insulation treatment after being assembled.

6. The electromagnetic switch device for starter according to claim 2, further comprising:

a cylindrical terminal block in which the main contact chamber and the sub coil are arranged so as to be adjacent to each other in a radial direction with a partition wall provided therebetween and separating the sub coil and the main contact chamber from each other.

7. The electromagnetic switch device for starter according to claim 6, wherein the terminal block has an opening of the main contact chamber, at one end in an output shaft direction of the motor, and has an opening constituting the sub contact chamber, at the other end in the output shaft direction.

8. The electromagnetic switch device for starter according to claim 6, further comprising:

an O ring for preventing water entry, the O ring being provided around at least one of an outer circumference of the battery terminal and an outer circumference of the motor terminal.

9. The electromagnetic switch device for starter according to claim 6, wherein the sub yoke is provided so as to avoid a partition wall direction and an outermost circumferential direction of the terminal block.

10. The electromagnetic switch device for starter according to claim 6, wherein at least one of the pair of sub fixed cores is formed by the same member as the sub yoke and is formed integrally with the sub yoke.

11. The electromagnetic switch device for starter according to claim 6, wherein the sub coil and the sub contact chamber are located on one side with respect to a line connecting a center of the battery terminal and a center of the motor terminal, and the S terminal is located on the other side.

12. The electromagnetic switch device for starter according to claim 6, further comprising:

a fixing member serving as a magnetic circuit for the sub coil, fixing the terminal block and the pair of fixed cores, and made of a magnetic material.

13. The electromagnetic switch device for starter according to claim 6, wherein the terminal block has a protruding portion protruding toward an outer circumferential side with respect to the main yoke, and the sub coil and the sub contact chamber are provided inside the protruding portion.

14. The electromagnetic switch device for starter according to claim 13, wherein at least a part of the protruding portion is located on an inner side with respect to a tangent line connecting an outer circumference of the motor and an outer circumference of the main yoke.

15. The electromagnetic switch device for starter according to claim 1, wherein the pair of main fixed contacts and the pair of sub fixed contacts are arranged with their respective center lines parallel to each other.

16. The electromagnetic switch device for starter according to claim 4, wherein the connector assembly further includes a connector (E) having an end connected to one end of the sub coil, and another end electrically connected to the holding coil.

17. The electromagnetic switch device for starter according to claim 16, wherein the connector assembly further includes a connector (F) formed by a member integrated with the connector (E), the connector (F) having an end connected to a minus wire of the holding coil and electrically connected to a minus terminal of the battery.

18. The electromagnetic switch device for starter according to claim 4, wherein the connector assembly further includes a connector (E) having an end connected to one end of the sub coil and another end electrically connected to an E1 terminal forming an electric circuit for the sub coil.

19. The electromagnetic switch device for starter according to claim 4, wherein the connector assembly further includes a connector (E) having an end connected to one end of the sub coil and another end electrically connected to an E1 terminal forming an electric circuit for the sub coil, and a connector (F) formed by a member integrated with the connector (E), the connector (F) having an end connected to a minus wire of the holding coil and another end electrically connected to an E terminal electrically connected to a minus terminal of the battery.

* * * * *